US011377980B2

(12) United States Patent
Chui

(10) Patent No.: US 11,377,980 B2
(45) Date of Patent: Jul. 5, 2022

(54) SELF-RESETTING SINGLE-VALVE DOUBLE-PISTON HYDRAULIC DRIVE DEVICE AND METHOD FOR OVERHEAD CAM ENGINE

(71) Applicant: JIANGSU JOINTEK PRECISION MACHINERY CO., LTD, Changzhou (CN)

(72) Inventor: Lap Lam Chui, Changzhou (CN)

(73) Assignee: JIANGSU JOINTEK PRECISION MACHINERY CO., LTD, Changzhou (CN)

( * ) Notice: Subject to any disclaimer, the term of this patent is extended or adjusted under 35 U.S.C. 154(b) by 0 days.

(21) Appl. No.: 17/549,915

(22) Filed: Dec. 14, 2021

(65) Prior Publication Data

US 2022/0170390 A1 Jun. 2, 2022

Related U.S. Application Data

(63) Continuation of application No. PCT/CN2021/072988, filed on Jan. 21, 2021.

(30) Foreign Application Priority Data

Dec. 2, 2020 (CN) ..... 202011384578.3

(51) Int. Cl.

| | |
|---|---|
| ***F01L 1/18*** | (2006.01) |
| ***F01L 13/06*** | (2006.01) |
| ***F01L 1/26*** | (2006.01) |
| ***F01L 1/255*** | (2006.01) |

(Continued)

(52) U.S. Cl.

CPC ..... *F01L 1/181* (2013.01); *F01L 1/255* (2013.01); *F01L 1/267* (2013.01); *F01L 13/06* (2013.01);

(Continued)

(58) Field of Classification Search

CPC ... F01L 1/053; F01L 1/181; F01L 2001/2444; F01L 1/255; F01L 1/267; F01L 1/46; F01L 13/06; F01L 2305/02; F01L 2800/10

(Continued)

(56) References Cited

U.S. PATENT DOCUMENTS

| | | | |
|---|---|---|---|
| 6,439,195 | B1 | 8/2002 | Warner |
| 8,578,901 | B2 | 11/2013 | Ruggiero et al. |

(Continued)

FOREIGN PATENT DOCUMENTS

| | | | |
|---|---|---|---|
| CN | 201184224 | Y | 1/2009 |
| CN | 102787880 | A | 11/2012 |

(Continued)

*Primary Examiner* — Jorge L Leon, Jr.

(74) *Attorney, Agent, or Firm* — Bayramoglu Law Offices LLC

(57) ABSTRACT

A self-resetting single-valve double-piston hydraulic drive device and method for an overhead cam engine is disclosed. A primary driving piston and a secondary driving piston are respectively provided on a rocker arm body and a valve bridge body. The secondary driving piston is connected to an exhaust valve. When the drive control valve opens, the primary driving piston and the secondary driving piston realize a hydraulic linkage, during a drive lift, the secondary driving piston opens the exhaust valve. At the beginning of the positive-power lift, the secondary driving piston is automatically reset. When the control valve is closed, during the drive lift of an integrated cam, the primary driving piston absorbs the drive lift of an integrated cam assembly, the rocker arm body and the bridge body do not move, and the drive lift of the integrated cam is not transmitted to the exhaust valve.

20 Claims, 17 Drawing Sheets

(51) Int. Cl.
*F01L 1/053* (2006.01)
*F01L 1/24* (2006.01)
*F01L 1/46* (2006.01)

(52) U.S. Cl.
CPC ..... *F01L 1/053* (2013.01); *F01L 1/46* (2013.01); *F01L 2001/2444* (2013.01); *F01L 2305/02* (2020.05); *F01L 2800/10* (2013.01)

(58) Field of Classification Search
USPC ..... 123/90.16, 90.27, 90.36, 90.4, 90.44, 123/90.46
See application file for complete search history.

(56) References Cited

U.S. PATENT DOCUMENTS

| | | | | |
|---|---|---|---|---|
| 9,249,698 | B2 | 2/2016 | Gustafson et al. | |
| 2010/0319657 | A1* | 12/2010 | Dodi | F01L 13/065 123/321 |
| 2011/0132298 | A1 | 6/2011 | Ruggiero et al. | |
| 2012/0279463 | A1* | 11/2012 | Moller | F01L 13/06 123/90.12 |
| 2014/0109848 | A1 | 4/2014 | Janak et al. | |
| 2016/0069229 | A1* | 3/2016 | Baltrucki | F01L 1/46 123/90.12 |
| 2018/0087413 | A1* | 3/2018 | Xi | F02D 13/04 |
| 2020/0182102 | A1* | 6/2020 | Wang | F01L 13/06 |

FOREIGN PATENT DOCUMENTS

| | | | |
|---|---|---|---|
| CN | 204961000 | U | 1/2016 |
| CN | 106150589 | A | 11/2016 |
| CN | 106640257 | A | 5/2017 |
| CN | 110284937 | A | 9/2019 |
| CN | 112177702 | A | 1/2021 |
| WO | 2016041600 | A1 | 3/2016 |
| WO | 2016174493 | A1 | 11/2016 |

* cited by examiner

SELF-RESETTING SINGLE-VALVE DOUBLE-PISTON HYDRAULIC DRIVE DEVICE AND METHOD FOR OVERHEAD CAM ENGINE

CROSS REFERENCE TO THE RELATED APPLICATIONS

This application is the continuation application of International Application No. PCT/CN2021/072988, filed on Jan. 21, 2021, which is based upon and claims priority to Chinese Patent Applications No. 202011384578.3, filed on Dec. 2, 2020, the entire contents of which are incorporated herein by reference.

TECHNICAL FIELD

The present invention relates to the technical field of overhead cam engines, and more particularly, to a self-resetting single-valve double-piston hydraulic drive device and method for an overhead cam engine.

BACKGROUND

The concept and operation of the compression release engine brake are well known in the heavy commercial vehicle industry. The cost, power, reliability and engine modification requirements are often factors that determine whether to use the engine brake. There are several different types of compression release engine brakes in practical applications. Among them, the engine brake system integrated in the valve train has become more popular due to its low cost, high performance, reliability and compact structure.

One way to integrate the engine brake system is to integrate the drive valve lift into the positive cam, and add an "lost motion" device to the valve train to hide or prohibit the engine from implementing the brake lift of the valve in the positive mode.

In a first example, the US patent application U.S. Ser. No. 13/004,695 filed in January 2011 discloses a braking-type engine brake system and method. The braking-type engine brake system is provided in a valve bridge having one or more brake pistons and reset devices. In a second example, the US patent application U.S. 61/730,395 filed in November 2012 relates to a rocker arm brake reset device, which uses a cam and a reset pin to control the valve movement of a compression release brake. In a third example, the international patent application WO2016041600A1 filed in September 2014 discloses an exhaust valve rocker arm assembly. The exhaust valve rocker arm assembly can operate in an internal combustion engine mode and an engine braking mode, and a pressure relief valve for resetting is provided in the rocker arm assembly. Special reset devices are used in these examples, which reset the brake exhaust valve after the brake lift, thereby reducing or eliminating the increase in the positive-power exhaust lift caused by increasing the brake lift, the decrease in braking power caused by the increase in the overlap between the positive-power exhaust lift and the positive-power intake lift, and the increase in the possibility of contact between the exhaust valve and the cylinder piston. The reset function can also help the exhaust valve to be evenly closed according to a designed exhaust valve cam closing ramp so as to control the seating velocity of the valve towards the valve seat. These additional reset devices can help improve system performance, but can simultaneously increase the system complexity, and therefore takes up more space and increases the brake cost. In addition, if the reset function is completed in case of a high system load, it may damage the overall reliability and durability of the system.

SUMMARY

The present invention provides a self-resetting single-valve double-piston hydraulic drive device and method for an overhead cam engine. The present invention solves the following technical problems: the existing engine valve train has a compact structure, and it is hard to provide a hydraulic drive device; the engine drive function and the automatic valve clearance adjustment function cannot coexist; and an additional reset device will complicate the system and reduce the reliability.

In order to solve the above-mentioned technical problems, the present invention adopts the following technical solution: a self-resetting single-valve double-piston hydraulic drive device for an overhead cam engine. The device includes:

a rocker arm assembly, where the rocker arm assembly includes a rocker arm body and a driving oil passage; and one end of the rocker arm body is provided with a primary driving piston, and the other end of the rocker arm body is provided with a first elephant foot assembly;

an integrated cam assembly, where the integrated cam assembly includes an integrated cam, and the integrated cam assembly is provided below the primary driving piston and is configured to drive the rocker arm body to rotate;

an exhaust valve assembly, where the exhaust valve assembly includes an inner-side exhaust valve and an outer-side exhaust valve;

a valve bridge assembly, where the valve bridge assembly includes a valve bridge body; the valve bridge body is located below the first elephant foot assembly; the valve bridge body is provided with a secondary driving piston and an oil drain passage; the oil drain passage connects the secondary driving piston with the driving oil passage; and the secondary driving piston is connected to the inner-side exhaust valve or the outer-side exhaust valve; and a limit assembly, where the limit assembly is located above the oil drain passage;

the driving oil passage connects the primary driving piston with the secondary driving piston; the driving oil passage is connected with an engine drive solenoid valve and a drive control valve, and the engine drive solenoid valve and the drive control valve are opened or closed simultaneously;

when the engine drive solenoid valve is opened and the drive control valve opens the driving oil passage: during a drive lift of the integrated cam, the limit assembly is in contact with the valve bridge body and seals the oil drain passage, the primary driving piston and the secondary driving piston are connected to form a hydraulic linkage, the secondary driving piston drives an exhaust valve connected to the secondary driving piston to open, and the rocker arm body and the valve bridge body do not move; during a positive-power exhaust lift of the integrated cam, the limit assembly is separated from the valve bridge body, the oil drain passage is opened, the secondary driving piston is automatically reset after oil is drained, the primary driving piston and the rocker arm body are rigidly connected, and the rocker arm body rotates to drive the valve bridge body to open the inner-side exhaust valve and the outer-side exhaust valve; and when the engine drive solenoid valve is closed and the drive control valve closes the driving oil passage: during the drive lift of the integrated cam, the primary driving piston absorbs the drive lift of the integrated cam assembly for the rocker arm body, the rocker arm body does not move, and the drive lift of the integrated cam is not transmitted to an exhaust valve side; thus, a positive-power "lost motion" function of a drive mechanism is realized; during the positive-power exhaust lift of the integrated cam, the primary driving piston and the rocker arm body are rigidly connected, and the rocker arm body rotates to drive the valve bridge body to open the inner-side exhaust valve and the outer-side exhaust valve.

In the present invention, the primary driving piston is provided on the rocker arm body, and the secondary driving piston is provided on the valve bridge body. The secondary driving piston is connected to the inner-side exhaust valve or the outer-side exhaust valve. The driving oil passage connects the primary driving piston with the secondary driving piston, and the driving oil passage is connected with the drive control valve. The driving oil passage is separated from an opening oil passage of the drive control valve, and the flow rate of the driving oil passage is not limited by the source and flow rate of the opening oil passage of the drive control valve. There is no need for an additional hydraulic clearance adjustment device or rocker arm biasing device. The primary driving piston and the rocker arm body directly form a hydraulic clearance adjustment function, which eliminates the noise, impact and wear caused by the valve clearance, and reduces the frequency of maintenance. When the engine drive solenoid valve is closed and the drive control valve closes the driving oil passage, during the drive lift of the integrated cam, the primary drive piston absorbs the drive lift of the integrated cam assembly for the rocker arm body. The drive lift of the integrated cam will not be transmitted to the exhaust valve side. The rocker arm body will not swing, and the valve bridge will not tilt. Compared with other rocker arm drives, the valve stem is not subject to a lateral load. The rocker arm body is less worn, and a bushing-less rocker arm design can be adopted. The primary driving piston, the secondary driving piston and the driving oil passage are integrated on the rocker arm assembly and the valve bridge assembly, and no additional space is required. The secondary driving piston and the oil drain passage are connected with each other. The secondary driving piston can be automatically reset after the hydraulic oil is drained, and no special reset device is required. The secondary driving piston is connected to one of the exhaust valves in the exhaust valve assembly, and when driving, only one exhaust valve is opened per cylinder. Compared with other drives that open dual exhaust valves, the system of the present invention has a lower driving load. In addition, the drive valve is not restricted by the position, and it can be very adjacent to the rocker arm shaft or far away from the rocker arm shaft, which is hard for other rocker actuators. There is no need to establish a large back pressure in an exhaust passage through an exhaust gas, and the thermal load is less. The primary driving piston is used for both positive-power and driving operations. The valve bridge assembly is provided below the first elephant foot assembly. The first elephant foot assembly is low-cost and easily adjustable. The present invention is compact in structure, simple to be provided on the engine valve train, convenient to design, low driving load, and improves the reliability and durability of engine operation.

Further, the driving oil passage may include a primary piston oil passage, a secondary piston oil passage and a control valve oil supply passage; the primary piston oil passage may be connected with the primary driving piston and the drive control valve; the secondary piston oil passage may be connected with the secondary driving piston and the drive control valve; the control valve oil supply passage may be connected with the drive control valve; and the engine drive solenoid valve may be connected on the control valve oil supply passage.

Further, the inner-side exhaust valve may be connected to the secondary driving piston.

When the inner-side exhaust valve is connected to the secondary driving piston, the limit assembly is the rocker arm body, and the limit surface is provided on the rocker arm body. When the limit surface is in contact with the valve bridge body, the limit surface limits the valve bridge body and seals the oil drain passage. The present invention uses the rocker arm body for limiting, which simplifies the overall structure and realizes a compact structure.

Further, the secondary piston oil passage may connect the drive control valve with the limit surface; and when the limit surface is in contact with the valve bridge body, the secondary piston oil passage may be connected with the oil drain passage.

Further, the secondary piston oil passage may be connected with the first elephant foot assembly; the valve bridge body may be provided with an inner-side connection passage; the first elephant foot assembly may be connected with the secondary driving piston through the inner-side connection passage; and when the limit surface is in contact with the valve bridge body, the limit surface may seal the oil drain passage.

Further, in order to lower the height of the rocker arm assembly on the integrated cam assembly side, the secondary piston oil passage may be connected with a second elephant foot assembly; the second elephant foot assembly may be provided on the rocker arm body and may be located directly above the oil drain passage; and when a lower end of the second elephant foot assembly is in contact with the valve bridge body, the second elephant foot assembly may be connected with the oil drain passage.

Further, the outer-side exhaust valve may be connected to the secondary driving piston; the secondary piston oil passage may be connected with the first elephant foot assembly; the valve bridge body may be provided with an outer-side connection passage; and the first elephant foot assembly may be connected with the secondary driving piston through the outer-side connection passage.

When the outer-side exhaust valve is connected to the secondary driving piston, the limit assembly may be a limit rod; the limit rod may be located directly above the oil drain passage; and when the limit rod is in contact with the valve bridge body, the limit rod may seal the oil drain passage.

In order to adjust the clearance between the limit assembly and the valve bridge assembly, the limit assembly further includes a bracket. The limit rod is adjustably provided on the bracket, and the position of the limit rod on the bracket is adjustable, such that the clearance between the limit assembly and the valve bridge assembly is adjustable.

Further, the primary driving piston may include a primary piston body; one end of the rocker arm body may be provided with a primary piston hole; the primary piston hole may be connected with the primary piston oil passage; the primary piston body may be coaxially and slidably provided in the primary piston hole; a primary elastic element and an anti-dropping assembly may be provided between the primary piston body and the primary piston hole; the anti-dropping assembly may restrict the primary piston body from moving out of the primary piston hole.

When the primary piston body is in contact with the integrated cam, the friction between the primary piston body and the integrated cam is sliding friction. In order to adapt to some heavy-load engine models and protect the primary piston body and the integrated cam, rolling friction is used. A roller pin is fixedly provided at the lower end of the primary piston body, and a roller is rotatably provided on the roller pin. An anti-rotation assembly is further provided between the primary piston body and the primary piston hole. The anti-rotation assembly restricts the primary piston body from rotating along the central axis of the primary piston body. The central axis of the roller and the central axis of the integrated cam are located on an identical plane. By providing the roller, the sliding friction between the primary piston body and the integrated cam becomes rolling friction. This avoids the friction and wear of the primary piston body and reduces the friction and wear of the integrated cam, thereby protecting the primary piston body and the integrated cam.

In order to adjust the movement stroke of the primary piston body in an axial direction of the primary piston hole, the primary driving piston further includes an adjusting bolt. The adjusting bolt is threadedly provided on the rocker arm body. The adjusting bolt is axially inserted in the primary piston hole.

Further, the secondary driving piston may include a secondary piston body; the secondary piston body may be connected to the inner-side exhaust valve or the outer-side exhaust valve; a secondary piston hole may be provided on the valve bridge body; the secondary piston hole may be connected with the oil drain passage; the secondary piston body may be coaxially and slidably provided in the secondary piston hole; and a secondary elastic element may be provided between the secondary piston body and the secondary piston hole.

Further, the rocker arm assembly may further include a rocker arm shaft; the drive control valve may be provided on the rocker arm body; the control valve oil supply passage includes a rocker arm shaft oil supply passage and a connecting oil supply passage; the rocker arm shaft oil supply passage may be provided at the rocker arm shaft; and the connecting oil supply passage may be provided at the rocker arm body; the connecting oil supply passage may be connected to the rocker arm shaft oil supply passage and the drive control valve. The rocker arm body is able to rotate on the rocker arm shaft. Therefore, in order to ensure an uninterrupted supply of lubricating oil during the rotation of the rocker arm body on the rocker arm shaft, the connecting oil supply passage may include a connecting oil supply section and an annular oil supply section. The annular oil supply section may be connected with the rocker arm shaft oil supply passage. The connecting oil supply section may be connected with the drive control valve.

Further, the drive control valve may include a control valve body and a return assembly; the return assembly may be in contact with the control valve body; the rocker arm body may be provided with a control valve hole; the control valve body may be coaxially and slidably provided in the control valve hole; and the control valve body may be provided with a primary control valve oil passage;

when the engine drive solenoid valve is opened, the rocker arm shaft oil supply passage, the control valve oil supply passage and the bottom of the control valve hole may be filled with oil, an oil pressure force of the bottom of the control valve hole may be greater than a force of the return assembly acting on the control valve body, the control valve body moves up to an opened position under the action of the oil pressure, and the primary control valve oil passage connects the primary piston oil passage with the secondary piston oil passage; and when the engine drive solenoid valve is closed, no oil pressure exists in the rocker arm shaft oil supply passage and the control valve oil supply passage, the control valve body may be in a closed position at the bottom of the control valve hole under the action of the return assembly, and the primary control valve oil passage may be always connected with the primary piston oil passage and is not connected with the secondary piston oil passage.

In order to supply oil to the driving oil passage and lubricate the first elephant foot assembly, the rocker arm assembly may further include a lubricating oil passage; the lubricating oil passage may be connected with the first elephant foot assembly and the control valve hole; in order to realize the communication between the lubricating oil passage and the driving oil passage, the control valve body may be further provided with a secondary control valve oil passage; the secondary control valve oil passage may be connected with the primary control valve oil passage through a communication passage provided at the control valve body; and a one-way valve may be coaxially and fixedly provided in the communication passage;

when the engine drive solenoid valve is opened and the drive control valve is in the opened position: when the integrated cam is in a section of a cam base circle, an oil pressure of the secondary control valve oil passage may be greater than an oil pressure of the primary control valve oil passage, the one-way valve opens the communication passage, and the lubricating oil passage may be connected with the secondary control valve oil passage, the primary control valve oil passage and the driving oil passage; during the drive lift of the integrated cam, the oil pressure of the primary control valve oil passage may be greater than the oil pressure of the secondary control valve oil passage, the one-way valve seals the communication passage, the lubricating oil passage may be connected with the secondary control valve oil passage, and may be not connected with the primary control valve oil passage and the driving oil passage; during the positive-power lift of the integrated cam, the oil pressure of the secondary control valve oil passage may be greater than the oil pressure of the primary control valve oil passage, the one-way valve opens the communication passage, and the lubricating oil passage may be connected with the secondary control valve oil passage, the primary control valve oil passage and the driving oil passage; and when the engine drive solenoid valve is closed and the drive control valve is in the closed position: the lubricating oil passage may be connected with the primary control valve oil passage, the oil pressure of the primary control valve oil passage may be greater than the oil pressure of the secondary control valve oil passage, and the one-way valve seals the communication passage; after lubricating oil fills the primary piston hole, the rocker arm assembly may be biased to a side of the valve bridge assembly; the primary driving piston absorbs the drive lift of the integrated cam assembly for the rocker arm body, and the primary driving piston and the rocker arm body form a hydraulic clearance adjuster to adjust a valve clearance.

Further, the return assembly may include an elastic return element and a control valve limit ring; the control valve limit ring may be coaxially and fixedly provided at an open end of the control valve hole; and the elastic return element may be located between the control valve body and the control valve limit ring; and when the drive control valve is in the closed position, the control valve body and the control valve limit ring may be spaced apart to form an open chamber; the open chamber may be connected with the secondary piston oil passage; and the open chamber may be connected with an outside environment.

Further, the rocker arm assembly may further include a rocker arm shaft; the drive control valve may be provided on the rocker arm shaft; and each of an end of the primary piston oil passage and an end of the secondary piston oil passage connected with the drive control valve may be an annular passage.

In order to meet the requirements of different manufacturing processes, the rocker arm body may be provided with an insert in an interference fit manner, and a lower surface of the insert may be a limit surface. The insert may be separately hardened or treated by other process to enhance the flexibility of process design.

Further, when the secondary piston oil passage does not pass through the first elephant foot assembly, the lubricating oil passage may include a rocker arm shaft lubricating oil passage and an elephant foot lubricating oil passage; the rocker arm shaft lubricating oil passage may be provided on the rocker arm shaft; and the elephant foot lubricating oil passage may be provided on the rocker arm body. The rocker arm body is able to rotate on the rocker arm shaft. Therefore, when the rocker arm body rotates on the rocker arm shaft, in order to ensure an uninterrupted supply of lubricating oil, the elephant foot lubricating oil passage may include a connecting lubrication section and an annular lubrication section. The annular lubrication section may connect the rocker arm shaft lubricating oil passage to the connecting lubrication section. The connecting lubrication section may be connected with the first elephant foot assembly.

Further, when the secondary piston oil passage passes through the elephant foot assembly, the lubricating oil passage may include a rocker arm shaft lubricating oil passage and an injection lubricating oil passage; the rocker arm shaft lubricating oil passage may be provided on the rocker arm shaft; the injection lubricating oil passage may be provided on the rocker arm body and include an injection lubrication section and an annular lubrication section; the annular lubrication section may be connected to the rocker arm shaft lubricating oil passage and the injection lubrication section; after the injection lubrication section penetrates through the rocker arm body, an oil outlet of the injection lubrication section may be opposite to the first elephant foot assembly, so the lubricating oil is directly injected on the first elephant foot assembly to lubricate the first elephant foot assembly.

Further, the integrated cam includes a cam base circle; above the cam base circle is provided with a positive-power exhaust lift lobe, a drive exhaust gas recirculation lift lobe and a compression release drive lift lobe in sequence.

A self-resetting single-valve double-piston hydraulic drive method for an overhead cam engine, includes: allowing an engine drive solenoid valve to operate in two working states, namely an opened state and a closed state;

when the engine drive solenoid valve is in the opened state, a rotation process along an integrated cam is implemented by the following steps:

step 1: when the engine drive solenoid valve is opened, a rocker arm shaft oil supply passage, a connecting oil supply passage and the bottom of a control valve hole are filled with oil, such that an oil pressure of the bottom of the control valve hole is greater than a force of an elastic return element acting on a control valve body, the control valve body moves up to an opened position under the action of the oil pressure, and a primary control valve oil passage connects a primary piston oil passage with a secondary piston oil passage;

step 2: when the integrated cam rotates to a cam base circle, a one-way valve ball is opened under an oil pressure of a secondary control valve oil passage to connect the primary control valve oil passage; lubricating oil flows into a drive control valve and an entire driving oil passage, a primary piston hole is filled with oil; a rocker arm body is biased to a side of a valve bridge body under the action of an oil pressure of the primary piston hole, a limit assembly is tightly attached to an upper surface of the valve bridge body, such that the secondary piston oil passage is connected with an oil drain passage on the upper surface of the valve bridge body, and the primary piston hole and a secondary piston hole are connected through the primary piston oil passage, the primary control valve oil passage, the secondary piston oil passage and the oil drain passage, and are filled with the lubricating oil simultaneously;

step 3: during a drive lift of the integrated cam, an integrated cam assembly pushes a primary piston body upward, such that the primary piston body moves upward along the primary piston hole, the one-way valve ball seals a communication passage, and the drive control valve is in a locked state; the lubricating oil in the primary piston hole is pressed into the secondary piston hole, such that a primary driving piston and a secondary driving piston form a hydraulic linkage, the secondary driving piston pushes away an inner-side exhaust valve connected to the secondary driving piston; the rocker arm body and the valve bridge body do not move; and thus, a drive function of a drive mechanism is realized; and step 4: during a positive-power exhaust lift of the integrated cam, the integrated cam assembly pushes the primary piston body upward, such that the primary piston body moves upward along the primary piston hole; when the primary piston body is pressed against the bottom of an adjusting bolt or the bottom of the primary piston hole, the primary piston body and the rocker arm body are rigidly connected; the rocker arm body starts to rotate, and a valve bridge assembly is pushed down through a first elephant foot assembly; a limit surface is separated from the upper surface of the valve bridge body, and the oil drain passage on the upper surface of the valve bridge body is automatically opened; the secondary piston body is in contact with the bottom of the secondary piston hole; and the valve bridge assembly is automatically reset to restore normal valve movement;

when the engine drive solenoid valve is in the closed state, the rotation process along the integrated cam is implemented by the following steps:

step 1: when the engine drive solenoid valve is closed, no oil pressure exists in the rocker arm shaft oil supply passage; the control valve body is in the closed position at the bottom of the control valve hole under the action of the elastic return element; the primary piston oil passage and the secondary piston oil passage are not connected; no oil pressure exists in a control valve oil supply passage; the primary piston oil passage and the primary piston hole are filled with the lubricating oil; and the secondary piston oil passage is connected with an open chamber, and no oil pressure exists in the secondary piston oil passage;

step 2: when the integrated cam rotates to the cam base circle, the lubricating oil fills the primary piston hole; the rocker arm assembly is biased to a side of the valve bridge assembly; the primary driving piston absorbs a drive lift of the integrated cam assembly for the rocker arm body; and the primary driving piston and the rocker arm body form a hydraulic clearance adjuster to adjust a valve clearance;

step 3: during the drive lift of the integrated cam, the integrated cam assembly pushes the primary piston body upward, such that the primary piston body moves upward along the primary piston hole; the rocker arm body is still biased to the side of the valve bridge body under the action of the oil pressure of the primary piston hole, but does not rotate; the drive lift of the integrated cam is absorbed by the primary driving piston and is not transmitted to the side of the valve bridge body; and thus, a positive-power "lost motion" function of the drive mechanism is realized; and step 4: during the positive-power exhaust lift of the integrated cam, the integrated cam assembly pushes the primary piston body upward, such that the primary piston body moves upward along the primary piston hole; when the primary piston body is pressed against the bottom of the adjusting bolt or the bottom of the primary piston hole, the primary piston body and the rocker arm body are rigidly connected; and the rocker arm body rotates, and the valve bridge assembly is pushed down through the first elephant foot assembly to achieve positive valve movement.

The present invention has the following beneficial effects: In the present invention, the primary driving piston is provided on the rocker arm body, and the secondary driving piston is provided on the valve bridge body. The secondary driving piston is connected to the inner-side exhaust valve or the outer-side exhaust valve. The driving oil passage connects the primary driving piston with the secondary driving piston, and the driving oil passage is connected with the drive control valve. When the drive control valve closes the driving oil passage, during the drive lift of the integrated cam, the primary drive piston absorbs the drive lift of the integrated cam assembly for the rocker arm body. The drive lift of the integrated cam will not be transmitted to the exhaust valve side. The rocker arm body will not swing, and the valve bridge will not tilt. Compared with other rocker arm drives, the valve stem is not subject to a lateral load. The rocker arm body is less worn, and a bushing-less rocker arm design can be adopted. The primary driving piston, the secondary driving piston and the driving oil passage are integrated on the rocker arm assembly and the valve bridge assembly, and no additional space is required. The secondary driving piston and the oil drain passage are connected with each other. The secondary driving piston can be automatically reset after the hydraulic oil is drained, and no special reset device is required. The secondary driving piston is connected to the inner-side exhaust valve or the outer-side exhaust valve, and when driving, only one exhaust valve is opened per cylinder. Compared with other drives that open dual exhaust valves, the system of the present invention has a lower driving load. In addition, the drive valve is not restricted by the position, and it can be very adjacent to the rocker arm shaft or far away from the rocker arm shaft, which is hard for other rocker actuators. There is no need for exhaust brake, and the thermal load is less. The primary driving piston is used for both positive-power and driving operations. The driving oil passage is separated from an opening oil passage of the drive control valve, and the flow rate of the driving oil passage is not limited by the source and flow rate of the opening oil passage of the drive control valve. There is no need for an additional hydraulic clearance adjustment device or rocker arm biasing device. The primary driving piston and the rocker arm body directly form a hydraulic clearance adjustment function, which eliminates the noise, impact and wear caused by the valve clearance, and reduces the frequency of maintenance. The present invention features a simple drive principle, a compact structure, convenient optimization, low driving load, and improves the operational reliability and durability of the engine drive.

BRIEF DESCRIPTION OF THE DRAWINGS

The present invention is described in further detail below with reference to the drawings and embodiments.

Figure 1:
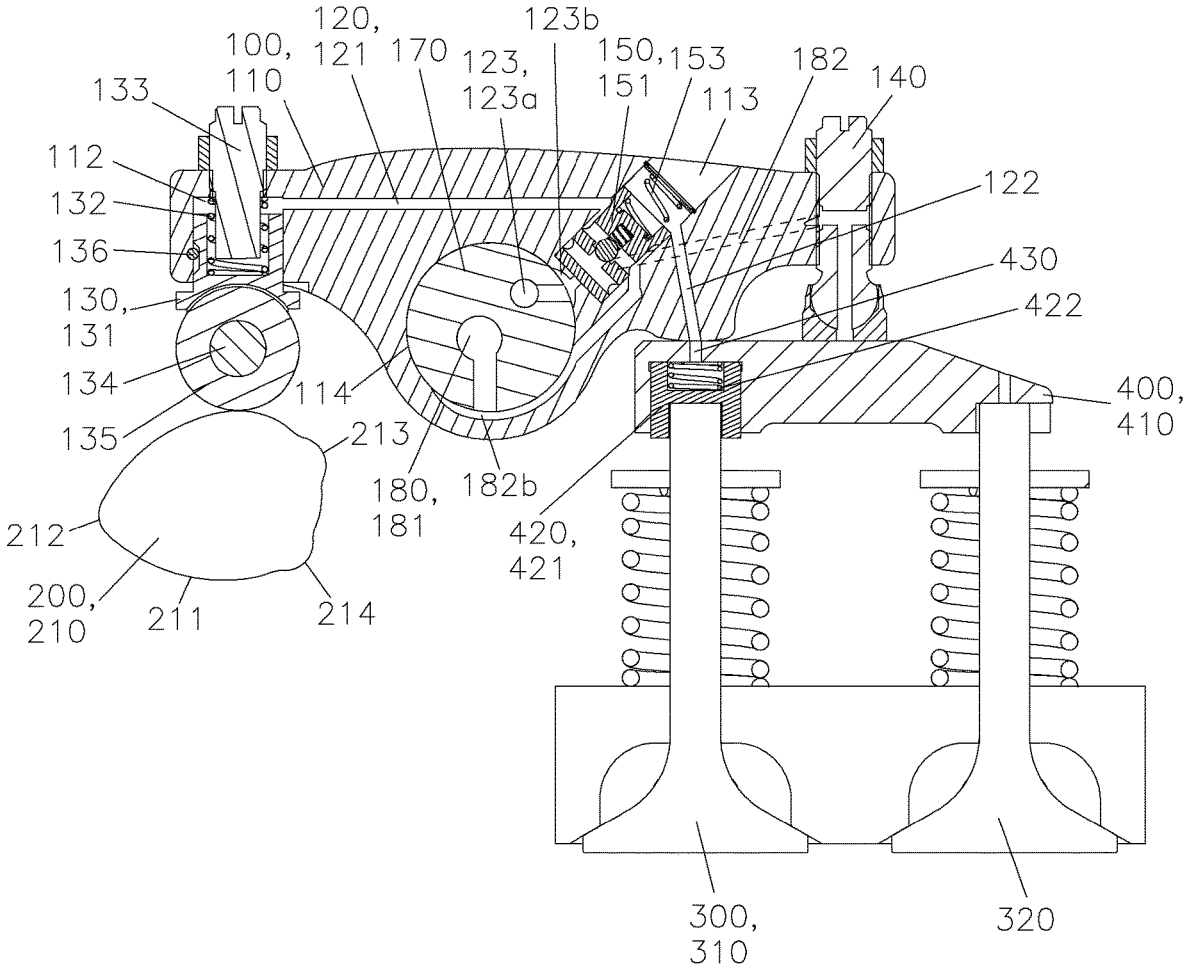
FIG. 1 is a two-dimensional (2D) view illustrating an integrated cam rotating to a cam base circle when an engine drive solenoid valve is closed and a drive control valve closes a driving oil passage in a positive work state of an engine according to Embodiment 1 of the present invention.
Figure 2:
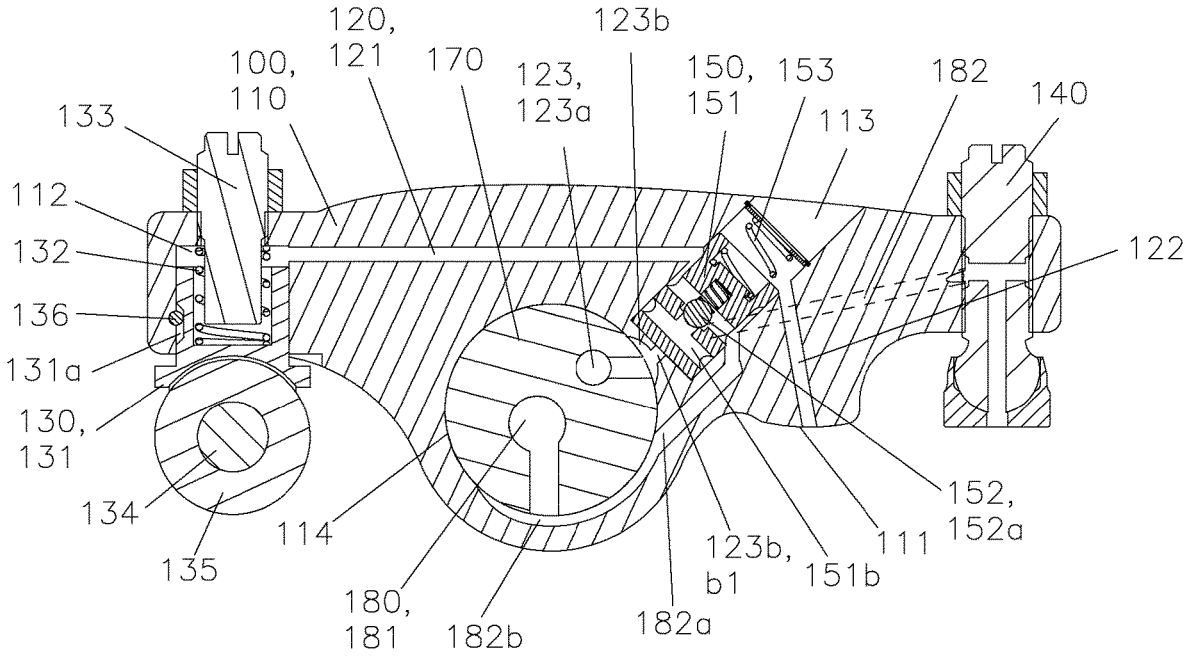
FIG. 2 is a 2D view illustrating a rocker arm assembly according to Embodiment 1 of the present invention.
Figure 3:
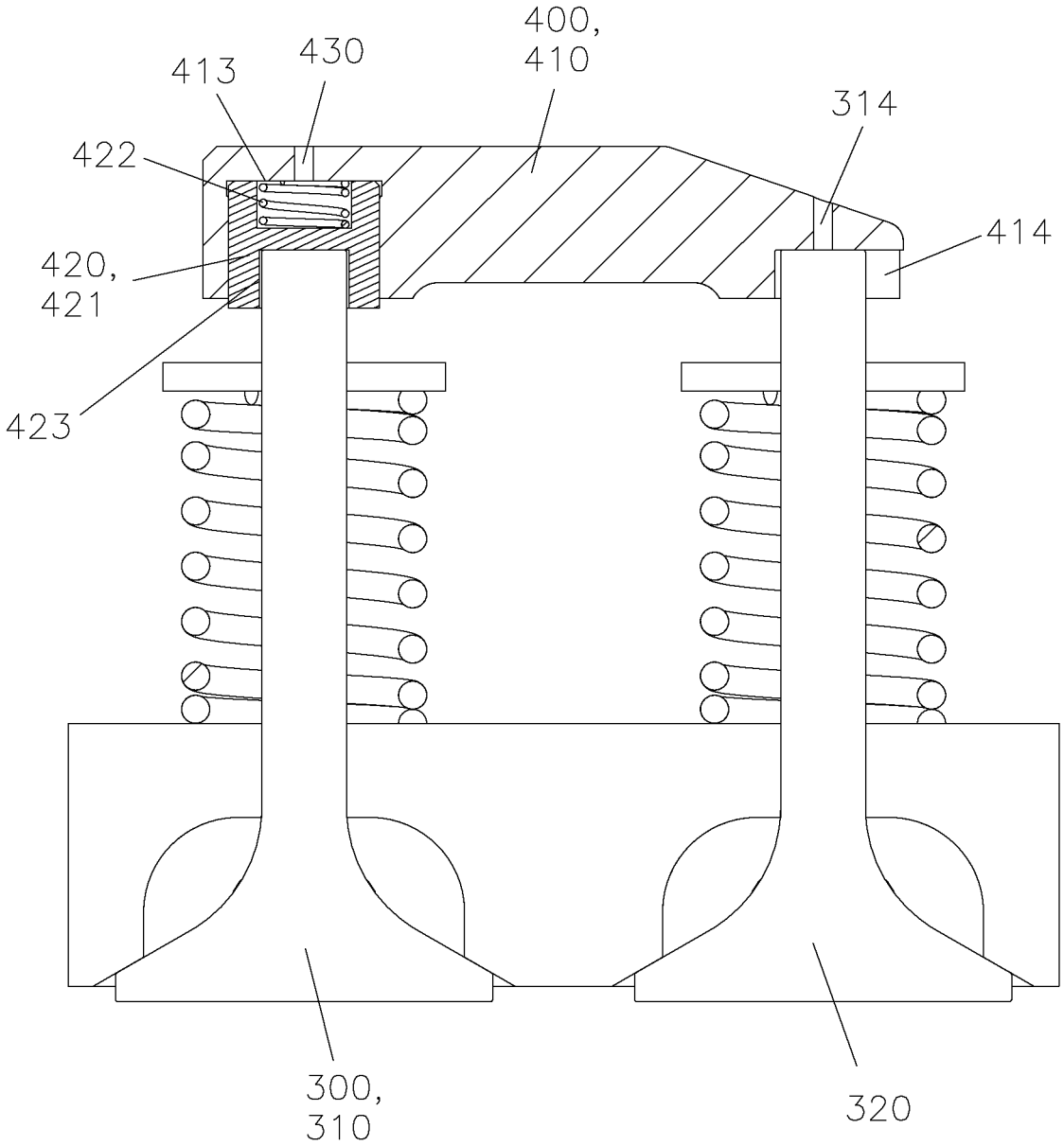
FIG. 3 is a 2D view illustrating a valve bridge assembly according to Embodiment 1 of the present invention.
Figure 4:
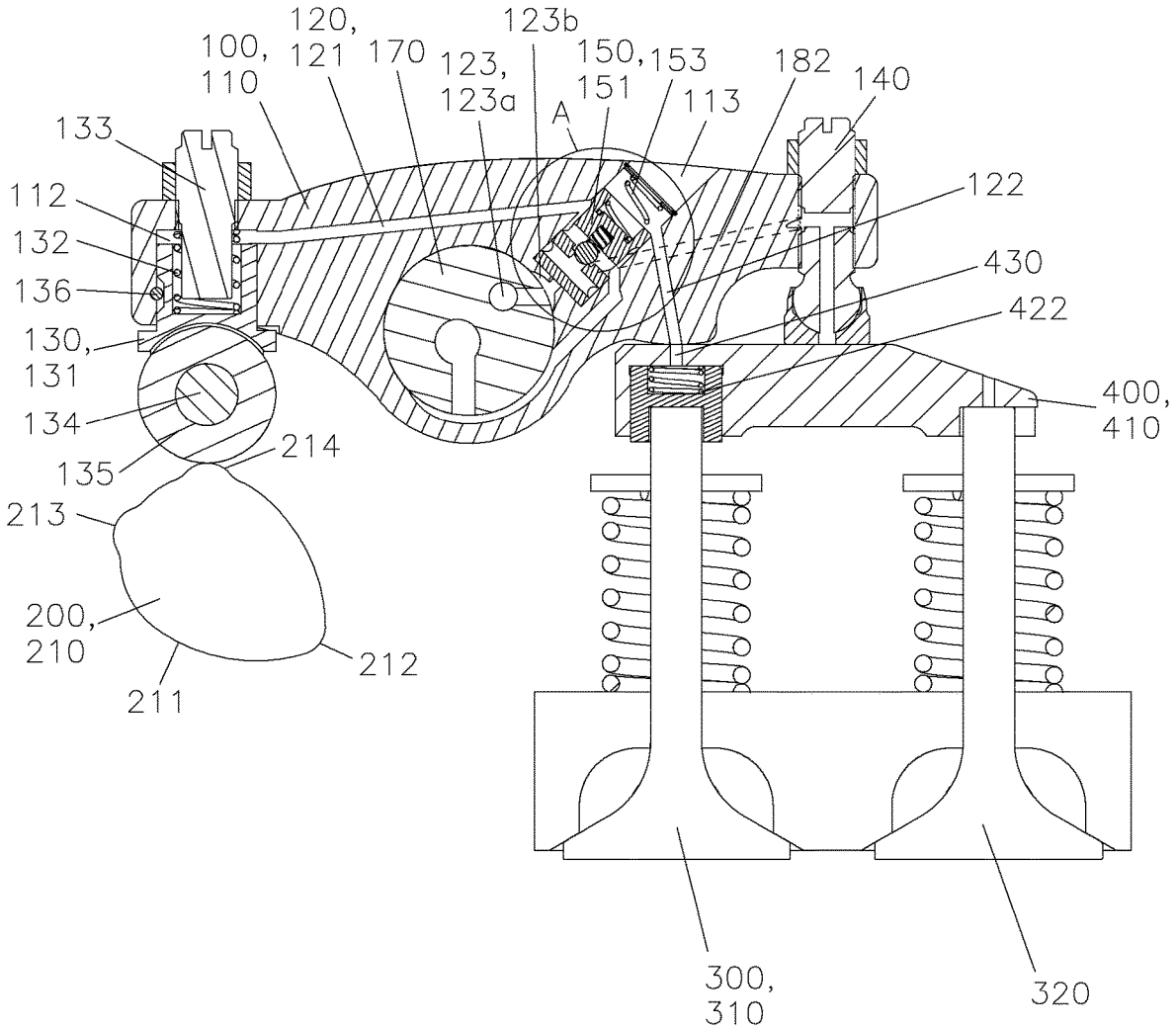
FIG. 4 is a 2D view illustrating the integrated cam rotating to a drive lift lobe when the engine drive solenoid valve is closed and the drive control valve closes the driving oil passage in the positive work state of the engine according to Embodiment 1 of the present invention.
Figure 5:
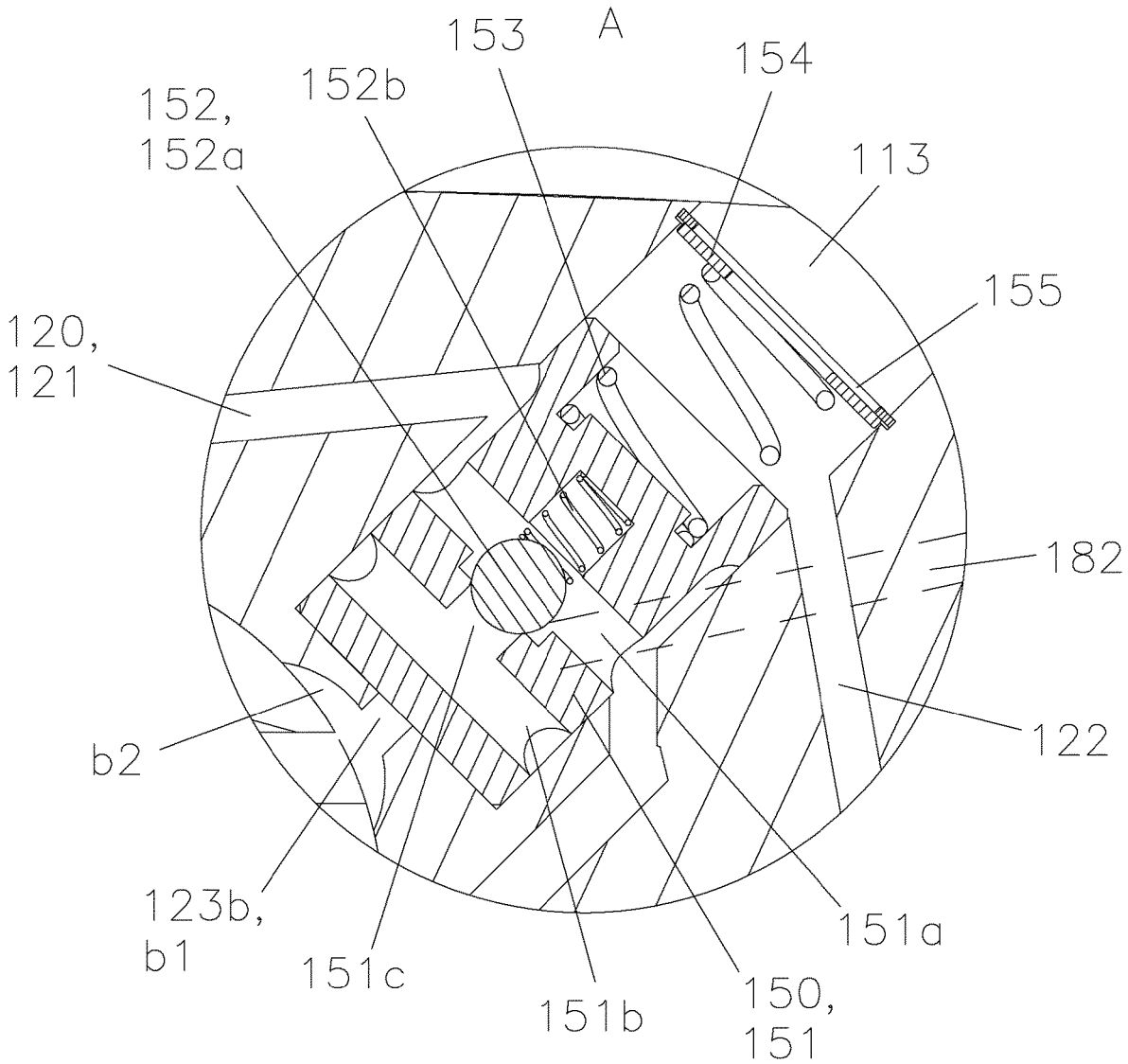
FIG. 5 is an enlarged view of A in FIG. 4.
Figure 6:
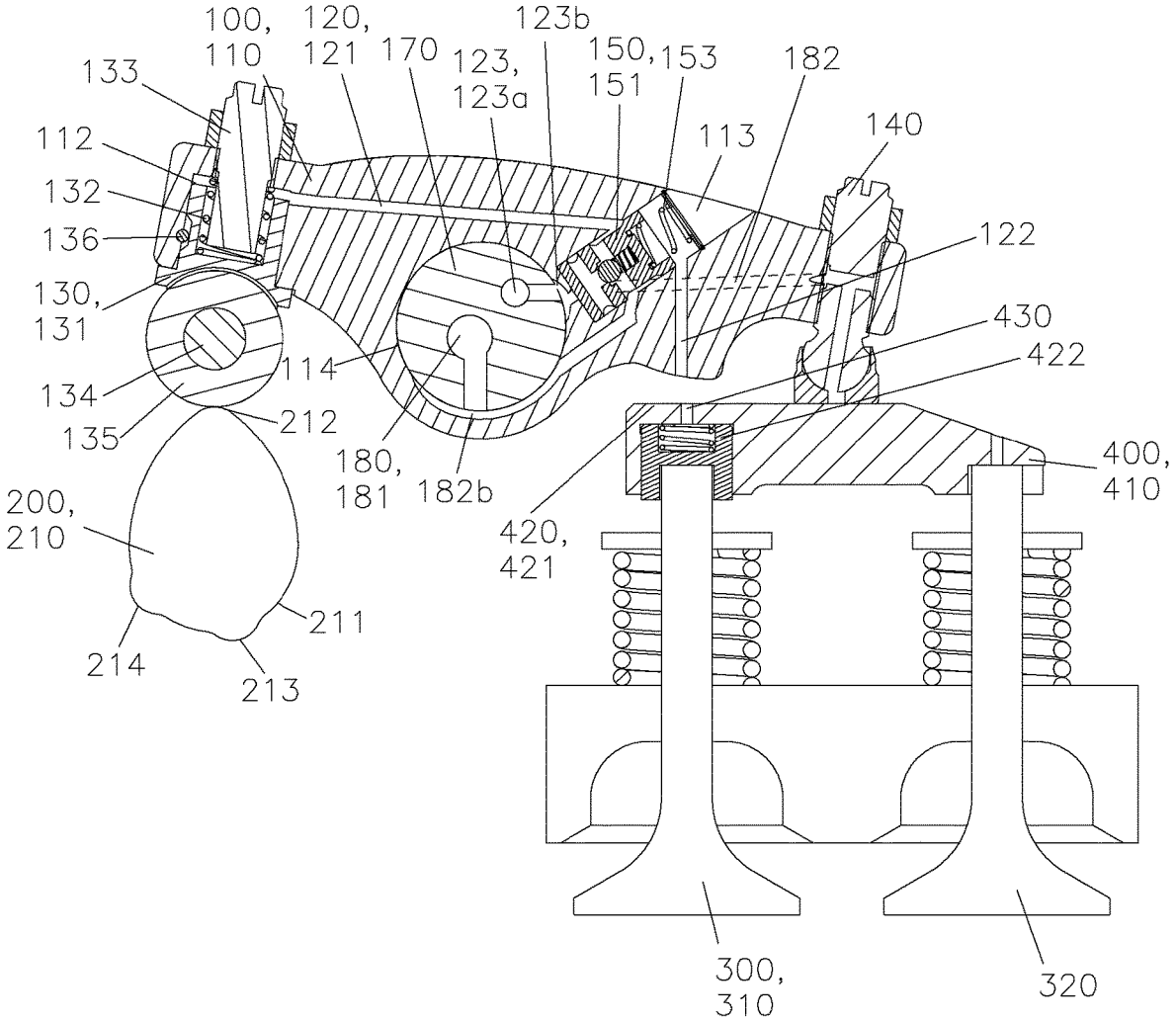
FIG. 6 is a 2D view illustrating the integrated cam during a positive-power exhaust lift when the engine drive solenoid valve is closed and the drive control valve closes the driving oil passage in the positive work state of the engine according to Embodiment 1 of the present invention.
Figure 7:
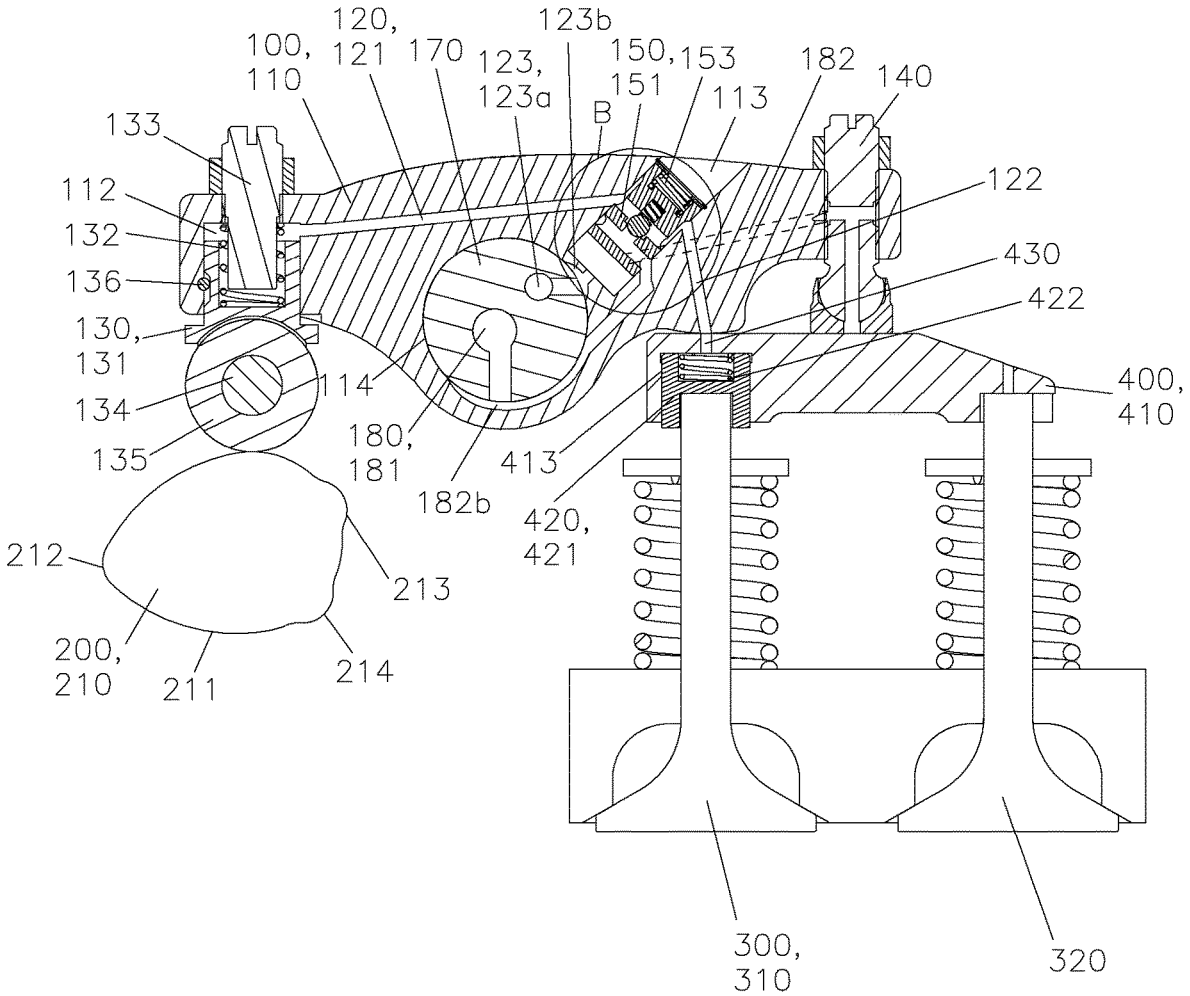
FIG. 7 is a 2D view illustrating the integrated cam rotating to the cam base circle when the drive control valve is in an opened position in a driving state of the engine according to Embodiment 1 of the present invention.
Figure 8:
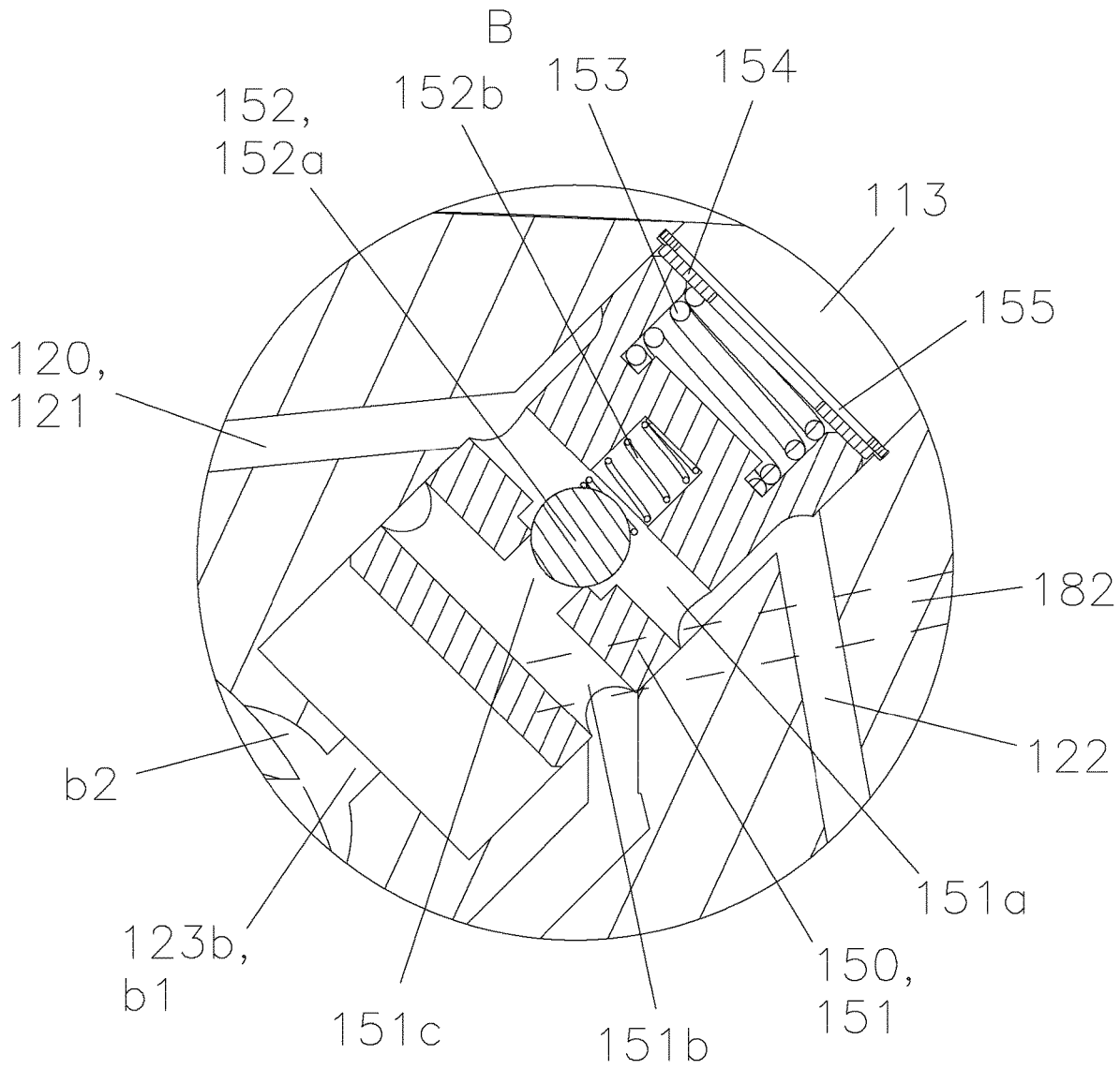
FIG. 8 is an enlarged view of B in FIG. 7.
Figure 9:
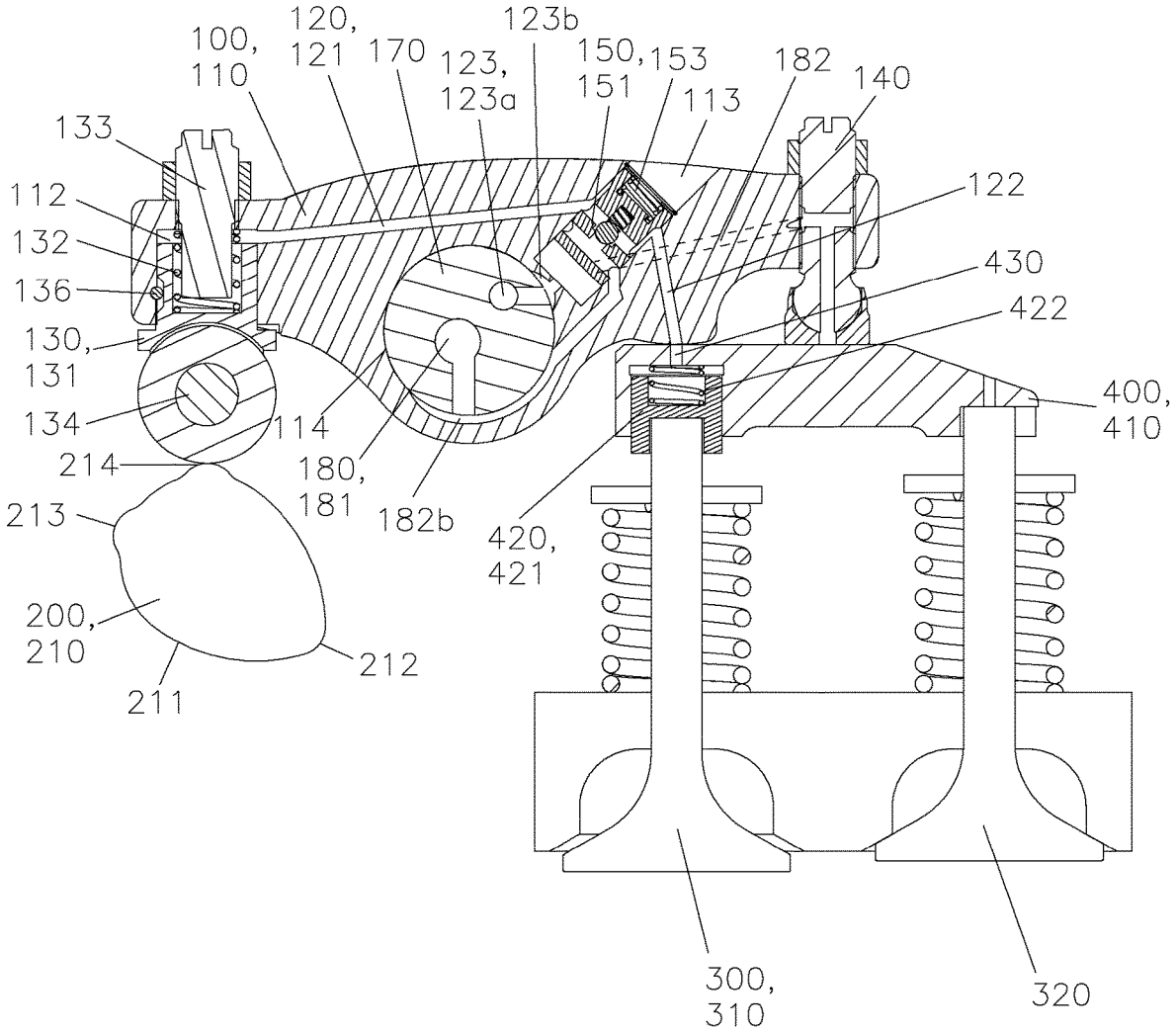
FIG. 9 is a 2D view illustrating a drive exhaust valve opened during the drive lift of the integrated cam when the drive control valve is in the opened position in the driving state of the engine according to Embodiment 1 of the present invention.
Figure 10:
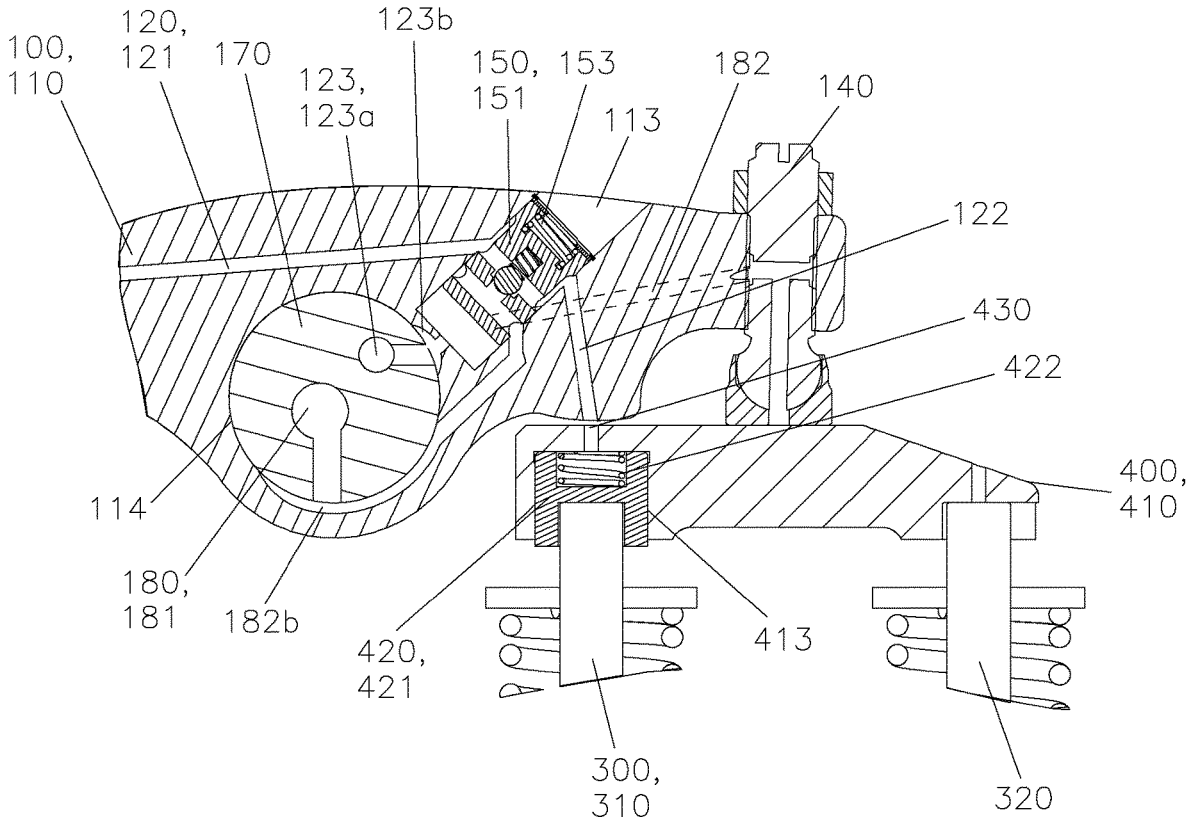
FIG. 10 is a 2D view illustrating a secondary driving piston automatically decompressing and reset in the driving state of the engine according to Embodiment 1 of the present invention.

Reference Numerals: 100. rocker arm assembly:

110. rocker arm body; 111. limit surface; 112. primary piston hole; 113. control valve hole; 114. rocker arm shaft hole;

120. driving oil passage: 121. primary piston oil passage; 122. secondary piston oil passage; 123. control valve oil supply passage; 123*a*. rocker arm shaft oil supply passage; 123*b*. connecting oil supply passage; b1. connecting oil supply section; b2. annular oil supply section;

130. primary driving piston: 131. primary piston body; 131*a*. limit opening; 132. primary elastic element; 133. adjusting bolt; 134. roller pin; 135. roller; 136. limit pin;

140. first elephant foot assembly;

150. drive control valve: 151. control valve body; 151*a*. primary control valve oil passage; 151*b*. secondary control valve oil passage; 151*c*. communication passage; 152. one-way valve; 152*a*. one-way valve ball; 152*b*. one-way valve spring; 153. elastic return element; 154. control valve limit ring; 155. control valve limit circlip;

160. second elephant foot assembly;

170. rocker arm shaft;

180. lubricating oil passage: 181. rocker arm shaft lubricating oil passage; 182. elephant foot lubricating oil passage; 182*a*. connecting lubrication section; 182*b*. annular lubrication section; 183. injection lubricating oil passage; 183*a*. injection lubrication section; 183*b*. annular lubrication section;

200. integrated cam assembly:

210. integrated cam: 211. cam base circle; 212. positive-power exhaust lift lobe; 213. drive exhaust gas recirculation lift lobe; 214. compression release drive lift lobe;

300. exhaust valve assembly: 310. inner-side exhaust valve; 314. upper lubricating oil passage; 320. outer-side exhaust valve;

400. valve bridge assembly:

410. valve bridge body; 411. inner-side connection passage; 412. outer-side connection passage; 413. secondary piston hole; 414. valve groove;

420. secondary driving piston: 421. secondary piston body; 422. secondary elastic element; 423. secondary piston valve base;

430. oil drain passage;

500. limit assembly: 510. limit rod; 520. bracket.

DETAILED DESCRIPTION OF THE EMBODIMENTS

The present invention is described in more detail below with reference to the drawings. These drawings are all simplified schematic diagrams, which merely illustrate the basic structure of the present invention in a schematic manner, and thus only show the parts associated with the present invention.

Embodiment 1

As shown in FIGS. 1 to 10, a self-resetting single-valve double-piston hydraulic drive device for an overhead cam engine includes a rocker arm assembly 100, an integrated cam assembly 200, an exhaust valve assembly 300, a valve bridge assembly 400 and a limit assembly 500. The rocker arm assembly 100 includes a rocker arm shaft 170, a rocker arm body 110 and a driving oil passage 120. The rocker arm shaft 170 is provided in a rocker arm shaft hole 114. The rocker arm body 110 is rotatably provided on the rocker arm shaft 170. One end of the rocker arm body 110 is provided with a primary driving piston 130, and the other end of the rocker arm body 110 is provided with a first elephant foot assembly 140. The primary driving piston 130 includes a primary piston body 131. The primary piston body 131 may be cylindrical or may be a stepped post with steps. One end of the rocker arm body 110 is provided with a primary piston hole 112. The primary piston hole 112 is connected with a primary piston oil passage 121. The primary piston body 131 is coaxially and slidably provided in the primary piston hole 112. A primary elastic element 132 and an anti-dropping assembly are provided between the primary piston body 131 and the primary piston hole 112. The anti-dropping assembly restricts the primary piston body 131 from moving out of the primary piston hole 112. A roller pin 134 is fixedly provided at a lower end of the primary piston body 131. A roller 135 is rotatably provided on the roller pin 134. An anti-rotation assembly is further provided between the primary piston body 131 and the primary piston hole 112. The anti-rotation assembly restricts the primary piston body 131 from rotating along the central axis of the primary piston body. Central axes of the roller 135 and an integrated cam 210 are located on an identical plane. The primary elastic element 132 may be a compression spring, and the compression spring serves as a primary piston spring. In order to simplify the overall structure of the primary driving piston 130, all the functions of the anti-dropping assembly and the anti-rotation assembly may be realized by a simple structure. In the present invention, the simple structure includes a limit pin 136. The limit pin 136 is fixedly provided on an inner circumferential surface of the primary piston hole 112. The primary piston body 131 is provided with a limit opening 131*a*. The limit opening 131*a* is provided along an axial direction of the primary piston body 131. The limit pin 136 is inserted in the limit opening 131*a*. The length of the limit opening 131*a* is greater than or equal to a movement stroke of the primary piston body 131. The limit pin 136 restricts the primary piston body 131 from moving out of the primary piston hole 112. The width of the limit opening 131*a* is equal to the diameter of the limit pin 136. The limit pin 136 is clamped in the limit opening 131*a*. The limit pin 136 is able to limit the rotation of the primary piston body 131.

In order to adjust the movement stroke of the primary piston body 131 in the axial direction of the primary piston hole 112, the primary driving piston 130 further includes an adjusting bolt 133. The adjusting bolt 133 is threadedly provided on the rocker arm body 110. The adjusting bolt 133 is axially inserted into the primary piston hole 112. The length of the adjusting bolt 133 inserted into the primary piston hole 112 is adjustable. In this embodiment, the first elephant foot assembly 140 used is an existing rocker arm elephant foot.

The integrated cam assembly 200 is provided below the primary driving piston 130 and is configured to drive the rocker arm body 110 to rotate. The integrated cam assembly 200 includes the integrated cam 210. The integrated cam 210 includes a cam base circle 211. The cam base circle 211 is provided with a positive-power exhaust lift lobe 212, a drive exhaust gas recirculation lift lobe 213 and a compression release drive lift lobe 214 in sequence.

The exhaust valve assembly 300 includes an inner-side exhaust valve 310 and an outer-side exhaust valve 320. The inner-side exhaust valve 310 is an exhaust valve on a side adjacent to the rocker arm shaft 170, and the outer-side exhaust valve 320 is an exhaust valve on a side away from the rocker arm shaft 170. The inner-side exhaust valve 310 is connected to the secondary driving piston 420.

The valve bridge assembly 400 includes a valve bridge body 410. The valve bridge body 410 is located below the first elephant foot assembly 140. The valve bridge body 410 is provided with a secondary driving piston 420 and an oil drain passage 430. The oil drain passage 430 connects the secondary driving piston 420 with the driving oil passage 120. The secondary driving piston 420 is connected to the inner-side exhaust valve 310. The secondary driving piston 420 includes a secondary piston body 421. The secondary piston body 421 is connected to the inner-side exhaust valve 310. A secondary piston hole 413 is provided on a side of the valve bridge body 410 adjacent to the rocker arm shaft 170. The secondary piston hole 413 is connected with the oil drain passage 430. The secondary piston body 421 is coaxially and slidably provided in the secondary piston hole 413. A secondary elastic element 422 is provided between the secondary piston body 421 and the secondary piston hole 413. The secondary elastic element 422 is a compression spring, and the compression spring serves as a secondary piston spring. A valve groove 414 is provided on a side of the valve bridge body 410 away from the rocker arm shaft 170. An upper lubricating oil passage 314 is provided above the valve groove 414. A mounting hole is provided at a lower end of the secondary piston body 421, and a secondary piston valve base 423 is formed. The inner-side exhaust valve 310 or the outer-side exhaust valve 320 is fixedly provided in the secondary piston valve base 423.

The limit assembly 500 is the rocker arm body 110. The rocker arm body 110 is provided with a limit surface 111. When the limit surface 111 is in contact with the valve bridge body 410, the limit surface limits the valve bridge body 410 and seals the oil drain passage 430.

The driving oil passage 120 connects the primary driving piston 130 with the secondary driving piston 420. The driving oil passage 120 is connected with an engine drive solenoid valve and a drive control valve 150, and the engine drive solenoid valve and the drive control valve 150 are opened or closed simultaneously. The driving oil passage 120 includes a primary piston oil passage 121, a secondary piston oil passage 122 and a control valve oil supply passage 123. The primary piston oil passage 121 connects the primary driving piston 130 with the drive control valve 150. The secondary piston oil passage 122 connects the secondary driving piston 420 with the drive control valve 150. The control valve oil supply passage 123 is connected with the drive control valve 150. The engine drive solenoid valve is connected on the control valve oil supply passage 123. The control valve oil supply passage 123 includes a rocker arm shaft oil supply passage 123*a* and a connecting oil supply passage 123*b*. The rocker arm shaft oil supply passage 123*a* is provided at the rocker arm shaft 170. The connecting oil supply passage 123*b* is provided at the rocker arm body 110. The connecting oil supply passage 123*b* connects the rocker arm shaft oil supply passage 123*a* with the drive control valve 150. The rocker arm body 110 is able to rotate on the rocker arm shaft 170. Therefore, in order to ensure an uninterrupted supply of lubricating oil during the rotation of the rocker arm body 110 on the rocker arm shaft 170, the connecting oil supply passage 123*b* includes a connecting oil supply section b1 and an annular oil supply section b2. The annular oil supply section b2 is connected with the rocker arm shaft oil supply passage 123*a*. The connecting oil supply section b1 is connected with the drive control valve 150.

The drive control valve 150 is provided on the rocker arm body 110. A control valve hole 113 is provided at a middle position of the rocker arm body 110. The drive control valve 150 includes a control valve body 151 and a return assembly. The return assembly is in contact with the control valve body 151. The control valve body 151 is coaxially and slidably provided in the control valve hole 113. The control valve body 151 is provided with a primary control valve oil passage 151*a* and a secondary control valve oil passage 151*b*. The secondary control valve oil passage 151*b* is connected with the primary control valve oil passage 151*a* through a communication passage 151*c* provided at the control valve body 151. A one-way valve 152 is coaxially and fixedly provided in the communication passage 151*c*. The one-way valve 152 includes a one-way valve ball 152*a* and a one-way valve spring 152*b*. The one-way valve spring 152*b* is located between the one-way valve ball 152*a* and the control valve body 151. The control valve body 151 is provided with a blind mounting hole for mounting the one-way valve spring 152*b*. The one-way valve spring 152*b* is confined in the blind mounting hole. When the one-way valve 152 is closed, the one-way valve ball 152*a* seals the communication passage 151*c*. The return assembly includes an elastic return element 153, a control valve limit ring 154 and a control valve limit circlip 155. The elastic return element 153 may be a return spring. The control valve limit ring 154 is coaxially and fixedly provided on an open end of the control valve hole 113 through the control valve limit circlip 155. The elastic return element 153 is located between the control valve body 151 and the control valve limit ring 154. When the drive control valve 150 is in a closed position, the control valve body 151 and the control valve limit ring 154 are spaced apart to form an open chamber. The open chamber is connected with an outside environment. The open chamber is also connected with the secondary piston oil passage 122.

In order to supply oil to the driving oil passage 120 and lubricate the first elephant foot assembly 140, the rocker arm assembly 100 further includes a lubricating oil passage 180. The lubricating oil passage 180 is connected with the first elephant foot assembly 140, and is also connected with the driving oil passage 120 through the drive control valve 150. The lubricating oil passage 180 includes a rocker arm shaft lubricating oil passage 181 and an elephant foot lubricating oil passage 182. The rocker arm shaft lubricating oil passage 181 is provided on the rocker arm shaft 170. The elephant foot lubricating oil passage 182 is provided on the rocker arm body 110. The rocker arm body 110 is able to rotate on the rocker arm shaft 170. Therefore, when the rocker arm body 110 rotates on the rocker arm shaft 170, in order to ensure an uninterrupted supply of lubricating oil, the elephant foot lubricating oil passage 182 includes a connecting lubrication section 182*a* and an annular lubrication section 182*b*. The annular lubrication section 182*b* connects the rocker arm shaft lubricating oil passage 181 to the connecting lubrication section 182*a*. The connecting lubrication section 182*a* is connected with the first elephant foot assembly 140. The annular lubrication section 182*b* may also be provided on the rocker arm shaft 170.

When the inner-side exhaust valve 310 is connected to the secondary driving piston 420, the limit assembly 500 is the rocker arm body 110. A limit surface 111 is provided on the rocker arm body 110. The limit surface 111 is located on an inner upper side of the valve bridge body 410, and the limit surface 111 is located directly above the oil drain passage 430. The present invention uses the rocker arm body 110 for limiting, which simplifies the overall structure and realizes a compact structure. The secondary piston oil passage 122 connects the drive control valve 150 with the limit surface 111. When the limit surface 111 is in contact with the valve bridge body 410, the secondary piston oil passage 122 is connected with the oil drain passage 430.

The specific working principle of the present invention is as follows:

When the engine drive solenoid valve is opened, the rocker arm shaft oil supply passage 123*a*, the control valve oil supply passage 123 and the bottom of the control valve hole 113 are filled with oil. An oil pressure of the bottom of the control valve hole 113 is greater than a force of the return assembly acting on the control valve body 151. The control valve body 151 moves up to an opened position under the action of the oil pressure; and the primary control valve oil passage 151*a* connects the primary piston oil passage 121 with the secondary piston oil passage 122.

When the integrated cam 210 rotates to the cam base circle 211, an oil pressure of the secondary control valve oil passage 151*b* is greater than an oil pressure of the primary control valve oil passage 151*a*. The one-way valve 152 opens the communication passage 151*c*. The lubricating oil passage 180 is connected with the secondary control valve oil passage 151*b*, the primary control valve oil passage 151*a* and the driving oil passage 120. The lubricating oil flows into the drive control valve 150 and the entire driving oil passage 120, and the primary piston hole 112 is filled with oil. The primary piston body 131 supplements the clearance of the valve bridge assembly 400, and moves downward to push the roller 135 to tightly attach to the cam base circle 211. The rocker arm body 110 is biased to a side of the valve bridge body 410 under the action of the oil pressure of the primary piston hole 112. The limit surface 111 is tightly attached to the upper surface of the valve bridge body 410, such that the secondary piston oil passage 122 is connected with the oil drain passage 430 on the upper surface of the valve bridge body 410. The primary piston hole 112 and the secondary piston hole 413 are connected through the primary piston oil passage 121, the primary control valve oil passage 151*a*, the secondary piston oil passage 122 and the oil drain passage 430, and are filled with the lubricating oil simultaneously.

When the integrated cam 210 continues to rotate to the drive exhaust gas recirculation lift lobe 213 and the compression release drive lift lobe 214, that is, during the drive lift of the integrated cam 210, the integrated cam 210 pushes the roller 134 and the primary piston body 131 upward, such that the primary piston body 131 moves upward along the primary piston hole 112. The oil pressure of the primary control valve oil passage 151*a* is greater than the oil pressure of the secondary control valve oil passage 151*b*. The one-way valve 152 seals the communication passage 151*c*. The lubricating oil passage 180 is connected with the secondary control valve oil passage 151*b* and is not connected with the primary control valve oil passage 151*a* and the driving oil passage 120. The drive control valve 150 is in a locked state. Thus, the lubricating oil in the primary piston oil passage 121 and the primary control valve oil passage 151*a* connected to the drive control valve is caused to flow back. The lubricating oil in the primary piston hole 112 is pressed into the secondary piston hole 413, such that the drive control valve 150 seals the driving oil passage 120 between the primary driving piston 130 and the secondary driving piston 420. The primary driving piston 130 and the secondary driving piston 420 form a hydraulic linkage. The secondary driving piston 420 pushes away the inner-side exhaust valve 310 connected to the secondary driving piston 420. The rocker arm body 110 and the valve bridge body 410 do not move. Thus, a drive function of the drive mechanism is realized. It should be noted that in this case, the rocker arm body 110 is still biased to the side of the valve bridge body 410 under the action of the oil pressure of the primary piston hole 112, but does not rotate, and the valve bridge body 410 basically maintains a horizontally balanced position without deflection.

When the integrated cam 210 continues to rotate to an initial section of the positive-power exhaust lift lobe 212, the integrated cam 210 pushes the roller 135 and the primary piston body 131 upward, and the primary piston body 131 moves upward along the primary piston hole 112. When the integrated cam 210 continues to rotate on the positive-power exhaust lift lobe 212, the oil pressure of the secondary control valve oil passage 151*b* is greater than the oil pressure of the primary control valve oil passage 151*a*. The one-way valve 152 opens the communication passage 151*c*, and the lubricating oil passage 180 is connected with the secondary control valve oil passage 151*b*, the primary control valve oil passage 151*a* and the driving oil passage 120. When the primary piston body 131 is pushed to the bottom of the adjusting bolt 133, the primary piston body 131 and the rocker arm body 110 are rigidly connected. The rocker arm body 110 starts to rotate, and the valve bridge assembly 400 is pushed downward through the first elephant foot assembly 140. At this time, the limit surface 111 is separated from the upper surface of the valve bridge body 410, and the oil drain passage 430 on the upper surface of the valve bridge body 410 is automatically opened. The secondary driving piston 420 retracts along the secondary piston hole 413 under the action of the secondary elastic element 422, and the excess lubricating oil in the secondary piston hole 413 is discharged through the oil drain passage 430. The secondary driving piston 420 is reset after the oil is drained. When the secondary piston body 421 contacts the bottom of the secondary piston hole 413, the primary driving piston 130 and the rocker arm body 110 are rigidly connected. The rocker arm body 110 rotates, and the valve bridge assembly 400 is automatically reset. The valve bridge body 410 is driven to open the inner-side exhaust valve 310 and the outer-side exhaust valve 320 to restore normal valve movement.

When the engine drive solenoid valve is closed, no oil pressure exists in the rocker arm shaft oil supply passage 123*a*. The control valve body 151 is in the closed position at the bottom of the control valve hole 113 under the action of the return assembly. The lubricating oil passage 180 is connected with the primary control valve oil passage 151*a*. The oil pressure of the primary control valve oil passage 151*a* is greater than the oil pressure of the secondary control valve oil passage 151*b*. The one-way valve 152 seals the communication passage 151*c*.

The primary piston oil passage 121 and the secondary piston oil passage 122 are not connected. No oil pressure exists in the control valve oil supply passage 123. The primary piston oil passage 121 and the primary piston hole 112 are filled with the lubricating oil. The secondary piston oil passage 122 is connected with an open chamber, and no oil pressure exists in the secondary piston oil passage 122. Since there is no oil supplied to the oil passage of the secondary driving piston 420 in the valve bridge body 410, the driving oil passage 120 is closed.

When the integrated cam 210 rotates to the cam base circle 211, the lubricating oil fills the primary piston hole 112, and the primary driving piston 130 is filled with oil. After the lubricating oil fills the primary piston hole 112, the rocker arm assembly 100 is biased to a side of the valve bridge assembly 400. The primary driving piston 130 absorbs the drive lift of the integrated cam assembly 200 for the rocker arm body 110. The primary driving piston 130 and the rocker arm body 110 form a hydraulic clearance adjuster to adjust a valve clearance. The valve clearance refers to a clearance between a lower end surface of the first elephant foot assembly 140 and the upper end surface of the valve bridge body 410.

When the integrated cam 210 continues to rotate to the drive exhaust gas recirculation lift lobe 213 and the compression release drive lift lobe 214, that is, during the drive lift of the integrated cam 210, the integrated cam assembly 210 pushes the roller 135 and the primary piston body 131 upward, such that the primary piston body 131 moves upward along the primary piston hole 112. The rocker arm body 110 is still biased to the side of the valve bridge body 410 under the action of the oil pressure of the primary piston hole 112, but does not rotate. The drive lift of the integrated cam 210 is absorbed by the primary driving piston 130 and is not transmitted to the side of the valve bridge body 410. Thus, a positive "lost motion" function of the drive mechanism is realized.

When the integrated cam 210 continues to rotate to an initial section of the positive-power exhaust lift lobe 212, the integrated cam 210 pushes the roller 135 and the primary piston body 131 upward, such that the primary piston body 131 moves upward along the primary piston hole 112. When the primary piston body 131 is pressed against the bottom of the adjusting bolt 133, the primary piston body 131 and the rocker arm body 110 are rigidly connected. When the integrated cam 210 continues to rotate on the positive-power exhaust lift lobe 212, the rocker arm body 110 is rotated. The valve bridge assembly 400 is pushed down through the first elephant foot assembly 140 and drives the valve bridge body 410 to open the inner-side exhaust valve 310 and the outer-side exhaust valve 320, so as to achieve positive valve movement.

In the present invention, the primary driving piston 130 is provided on the rocker arm body 110, and the secondary driving piston 420 is provided on the valve bridge body 410. The secondary driving piston 420 is connected to the inner-side exhaust valve 310 or the outer-side exhaust valve 320. The driving oil passage 120 connects the primary driving piston 130 with the secondary driving piston 420, and the driving oil passage 120 is connected with the drive control valve 150. The driving oil passage 120 is separated from an opening oil passage of the drive control valve 150, and the flow rate of the driving oil passage 120 is not limited by the source and flow rate of the opening oil passage of the drive control valve 150. There is no need for an additional hydraulic clearance adjustment device or rocker arm biasing device. The primary driving piston 130 and the rocker arm body 110 directly form a hydraulic clearance adjustment function, which eliminates the noise, impact and wear caused by the valve clearance, and reduces the frequency of maintenance. When the engine drive solenoid valve is closed and the drive control valve 150 closes the driving oil passage 120, during the drive lift of the integrated cam 210, the primary drive piston 130 absorbs the drive lift of the integrated cam assembly 200 for the rocker arm body 110. The drive lift of the integrated cam 210 will not be transmitted to the exhaust valve side. The rocker arm body 110 will not swing, and the valve bridge 410 will not tilt. Compared with other rocker arm drives, the valve stem is not subject to a lateral load. The rocker arm body 110 is less worn, and a bushing-less rocker arm design can be adopted. The primary driving piston 130, the secondary driving piston 420 and the driving oil passage 120 are integrated on the rocker arm assembly 100 and the valve bridge assembly 400, and no additional space is required. The secondary driving piston 420 and the oil drain passage 430 are connected with each other. The secondary driving piston 420 can be automatically reset after the hydraulic oil is drained, and no special reset device is required. The secondary driving piston 420 is connected to the inner-side exhaust valve 310 or the outer-side exhaust valve 320, and when driving, only one exhaust valve is opened per cylinder. Compared with other drives that open dual exhaust valves, the system of the present invention has a lower driving load. In addition, the drive valve is not restricted by the position, and it can be very adjacent to the rocker arm shaft 170 or far away from the rocker arm shaft 170, which is hard for other rocker actuators. There is no need for exhaust brake, and the thermal load is less. The primary driving piston 130 is used for both positive-power and driving operations. The driving oil passage 120 is separated from an opening oil passage of the drive control valve 150, and the flow rate of the driving oil passage 120 is not limited by the source and flow rate of the opening oil passage of the drive control valve 150. There is no need for an additional hydraulic clearance adjustment device or rocker arm biasing device. The primary driving piston 130 and the rocker arm body 110 directly form a hydraulic clearance adjustment function, which eliminates the noise, impact and wear caused by the valve clearance, and reduces the frequency of maintenance. The present invention features a simple drive principle, a compact structure, convenient optimization, low driving load, and improves the operational reliability and durability of the engine drive.

Embodiment 2

Figure 11:
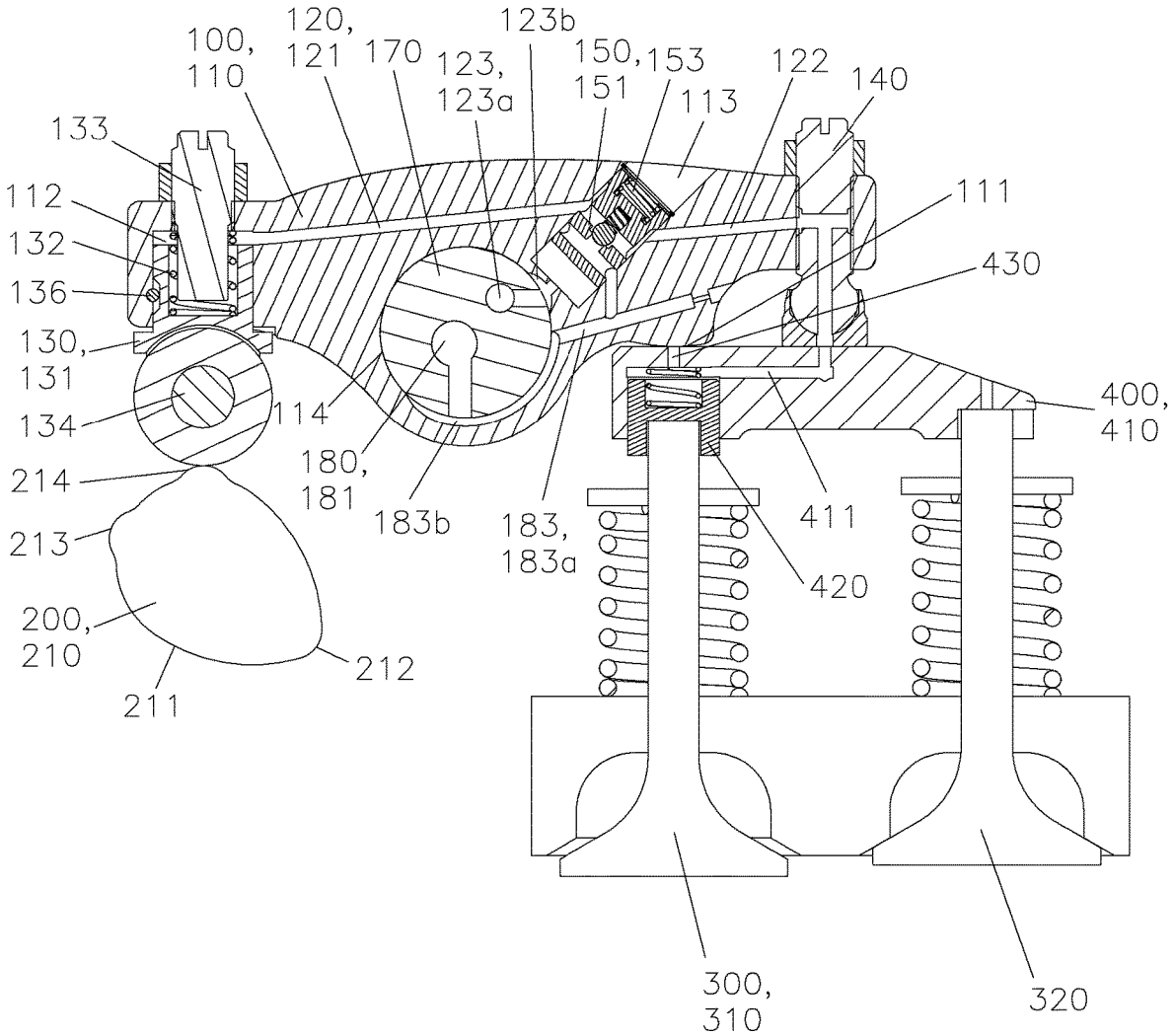
FIG. 11 is a 2D view of Embodiment 2 of the present invention.

Embodiment 2 shown in FIG. 11 only differs from Embodiment 1 in the following. The secondary piston oil passage 122 is connected with the first elephant foot assembly 140. The valve bridge body 410 is provided with an inner-side connection passage 411. The first elephant foot assembly 140 is connected with the secondary driving piston 420 through the inner-side connection passage 411. When the limit surface 111 is in contact with the valve bridge body 410, the limit surface 111 seals the oil drain passage 430.

When the secondary piston oil passage 122 passes through the elephant foot assembly 140, the lubricating oil passage 180 includes a rocker arm shaft lubricating oil passage 181 and an injection lubricating oil passage 183. The rocker arm shaft lubricating oil passage 181 is provided on the rocker arm shaft 170. The injection lubricating oil passage 183 is provided on the rocker arm body 110 and includes an injection lubrication section 183*a* and an annular lubrication section 183*b*. The annular lubrication section 183*b* connects the rocker arm shaft lubricating oil passage 181 to the injection lubrication section 183*a*. After the injection lubrication section 183*a* penetrates through the rocker arm body 110, an oil outlet of the injection lubrication section is opposite to the first elephant foot assembly 140, such the lubricating oil is directly injected on the first elephant foot assembly 140 to lubricate the first elephant foot assembly 140.

Embodiment 3

Figure 12:
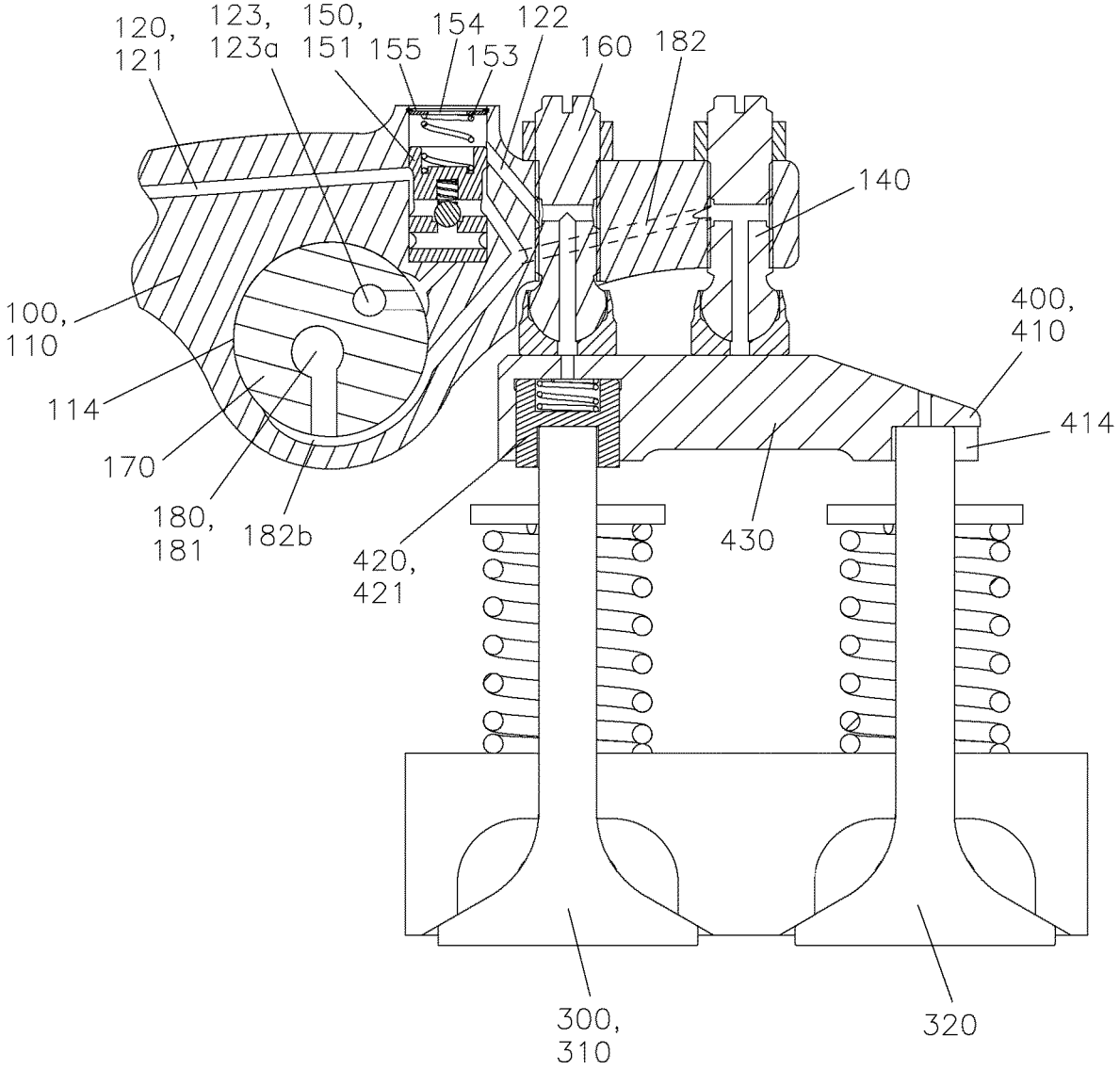
FIG. 12 is a 2D view of Embodiment 3 of the present invention.

Embodiment 3 shown in FIG. 12 only differs from Embodiment 2 in the following. In order to lower the height of the rocker arm assembly 100 on the side of the integrated cam assembly 200, the secondary piston oil passage 122 is connected with a second elephant foot assembly 160. The second elephant foot assembly 160 is provided on the rocker arm body 110 and is located directly above the oil drain passage 430. The second elephant foot assembly 160 may be screwed or fixedly provided on the rocker arm body 110. When a lower end of the second elephant foot assembly 160 is in contact with the valve bridge body 410, the second elephant foot assembly 160 is connected with the oil drain passage 430. In this embodiment, the second elephant foot assembly 160 used is an existing rocker arm elephant foot.

Embodiment 4

Figure 13:
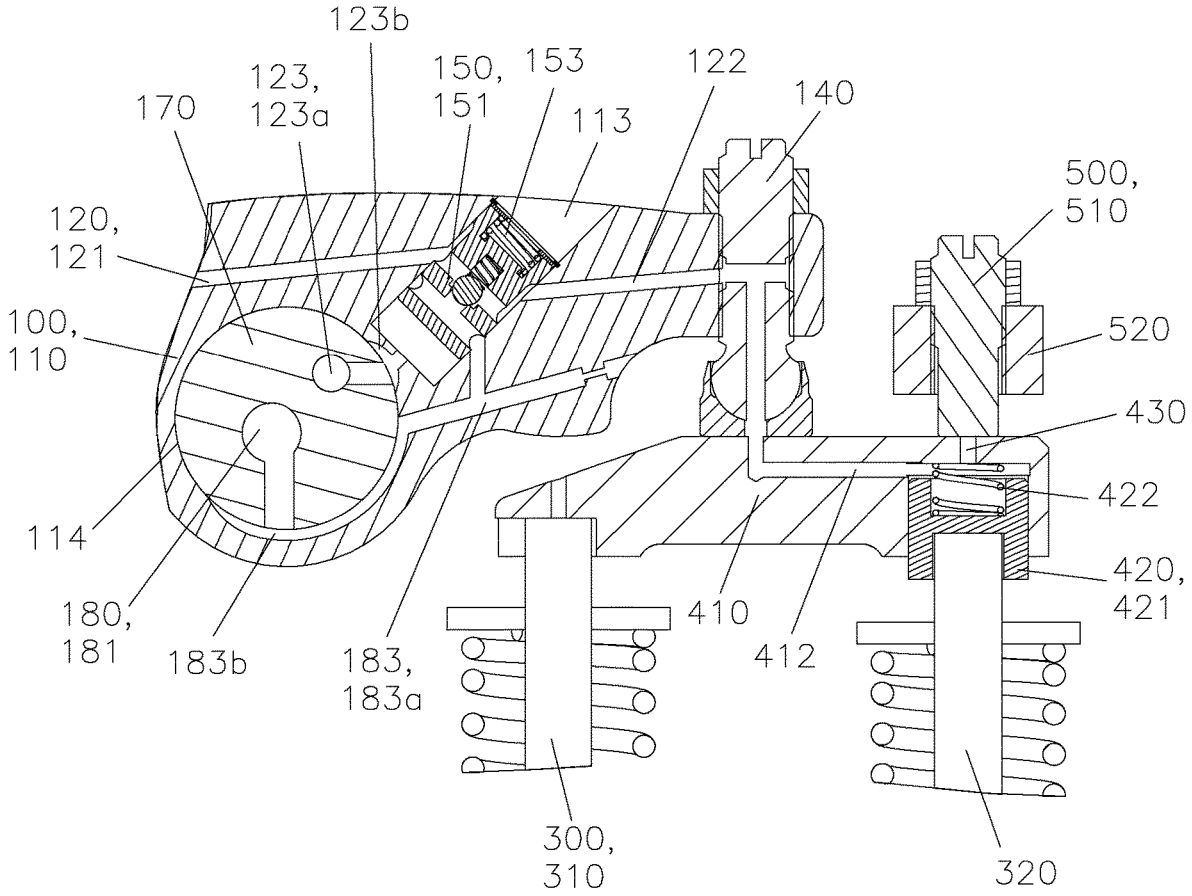
FIG. 13 is a 2D view of Embodiment 4 of the present invention.

Embodiment 4 shown in FIG. 13 only differs from Embodiment 1 in the following. The outer-side exhaust valve 320 is connected to the secondary driving piston 420. The secondary piston oil passage 122 is connected with the first elephant foot assembly 140. The valve bridge body 410 is provided with an outer-side connection passage 412. The first elephant foot assembly 140 is connected with the secondary driving piston 420 through the outer-side connection passage 412.

When the outer-side exhaust valve 320 is connected the secondary driving piston 420, the limit assembly 500 is a limit rod 510. The limit rod 510 may be provided with a flat or spherical end surface, and the limit rod 510 may also be provided with an elephant foot end surface structure. The limit rod 510 is located directly above the oil drain passage 430. When the limit rod 510 is in contact with the valve bridge body 410, the limit rod 510 seals the oil drain passage 430. In order to adjust the clearance between the limit assembly 500 and the valve bridge assembly 400, the limit assembly 500 further includes a bracket 520. The limit rod 510 is adjustably provided on the bracket 520 by screwing, that is, the limit rod 510 is threadedly provided on the bracket 520. The position of the limit rod 510 on the bracket 520 is adjustable, such that the clearance between the limit assembly 500 and the valve bridge assembly 400 is adjustable.

Embodiment 5

Figure 14:
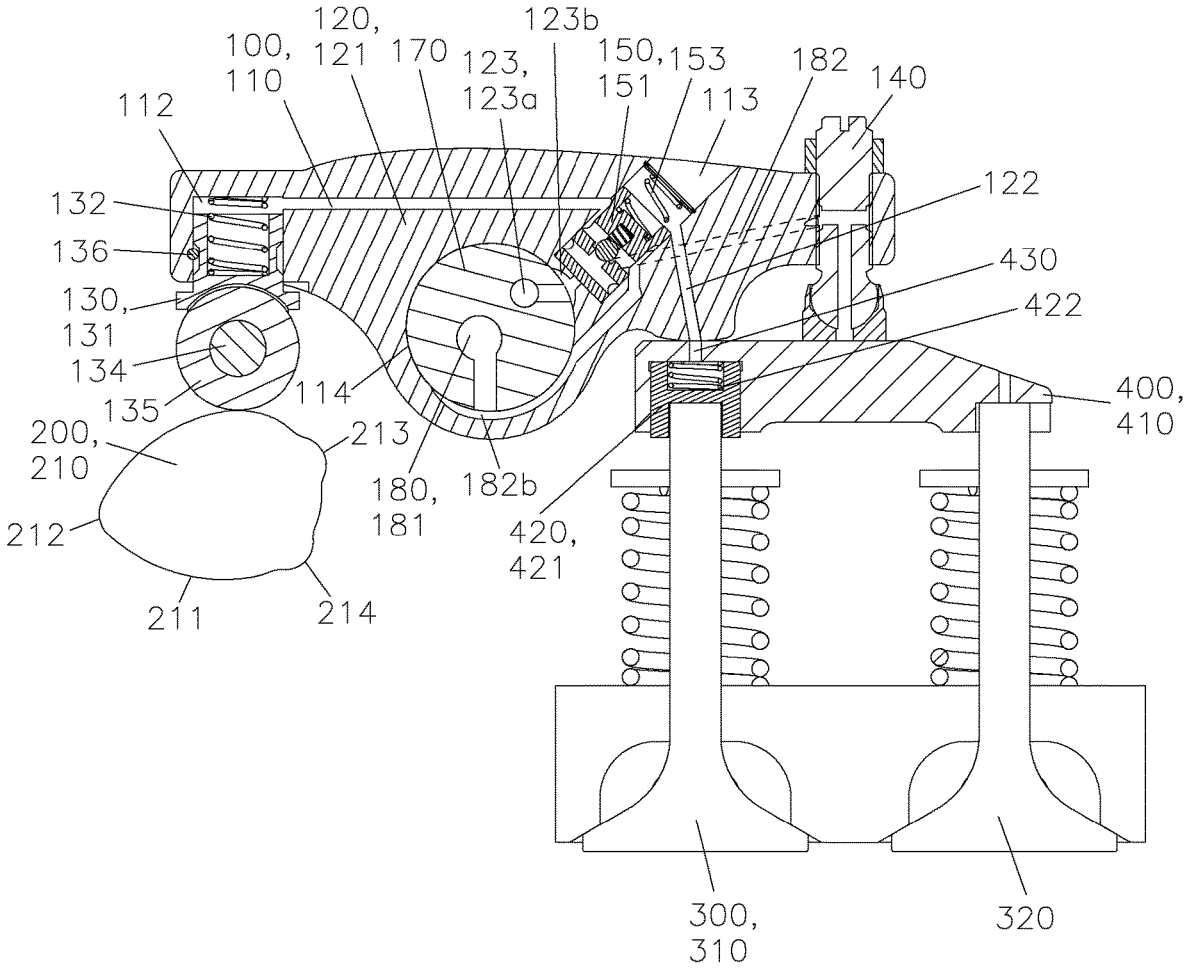
FIG. 14 is a 2D view of Embodiment 5 of the present invention.

Embodiment 5 shown in FIG. 14 only differs from Embodiment 1 in the following. The primary driving piston 130 does not include the adjusting bolt 133, and the movement stroke of the primary piston body 131 along the axial direction of the primary piston hole 112 is adjustable through the first elephant foot assembly 140.

Embodiment 6

Figure 15:
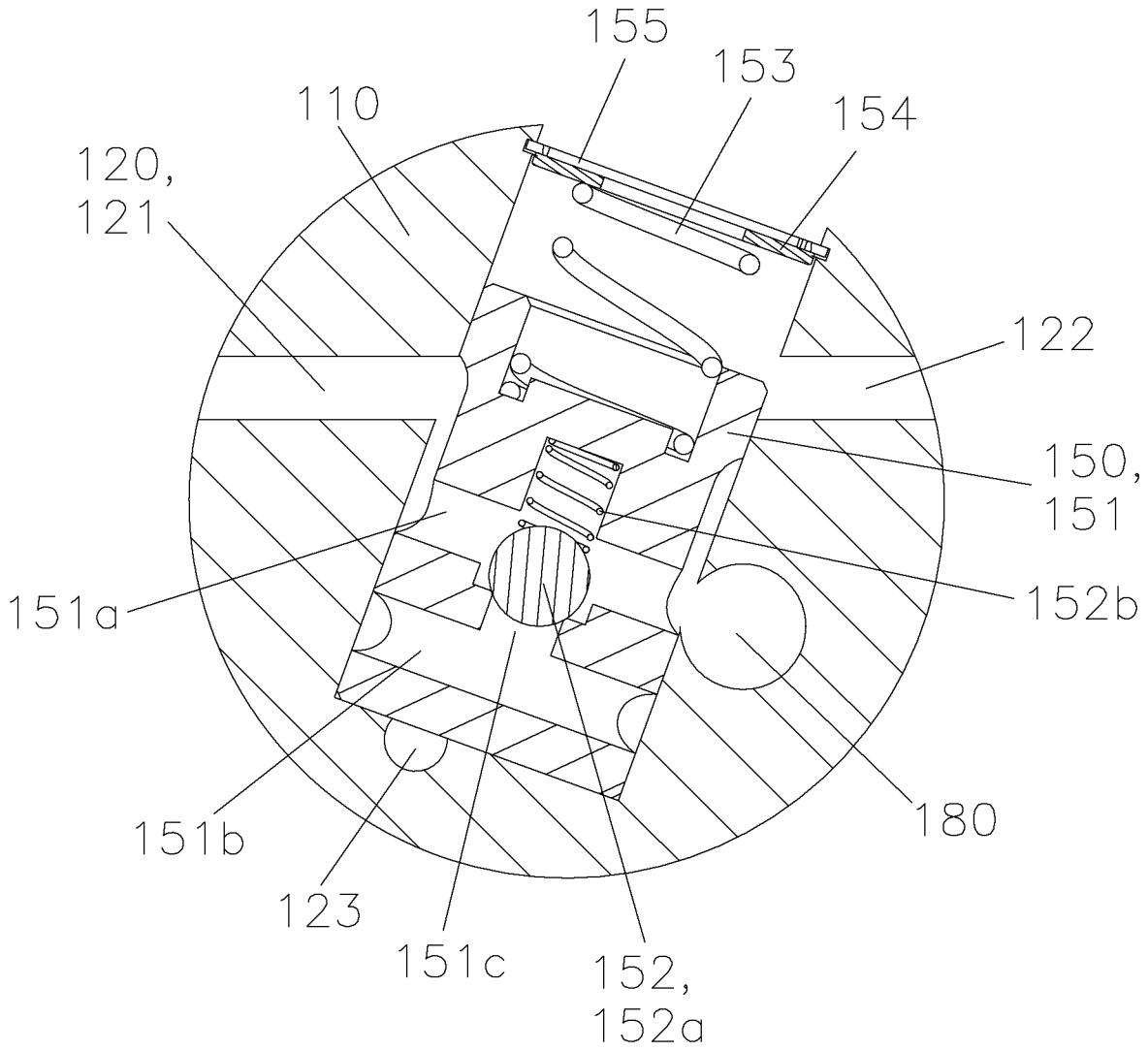
FIG. 15 is a 2D view of Embodiment 6 of the present invention.

Embodiment 6 shown in FIG. 15 only differs from Embodiment 1 in the following. The drive control valve 150 is provided on the rocker arm shaft 170; and each of an end of the primary piston oil passage 121 and an end of the secondary piston oil passage 122 connected with the drive control valve 150 is an annular passage coaxial with the rocker arm shaft 170.

Embodiment 7

Figure 16:
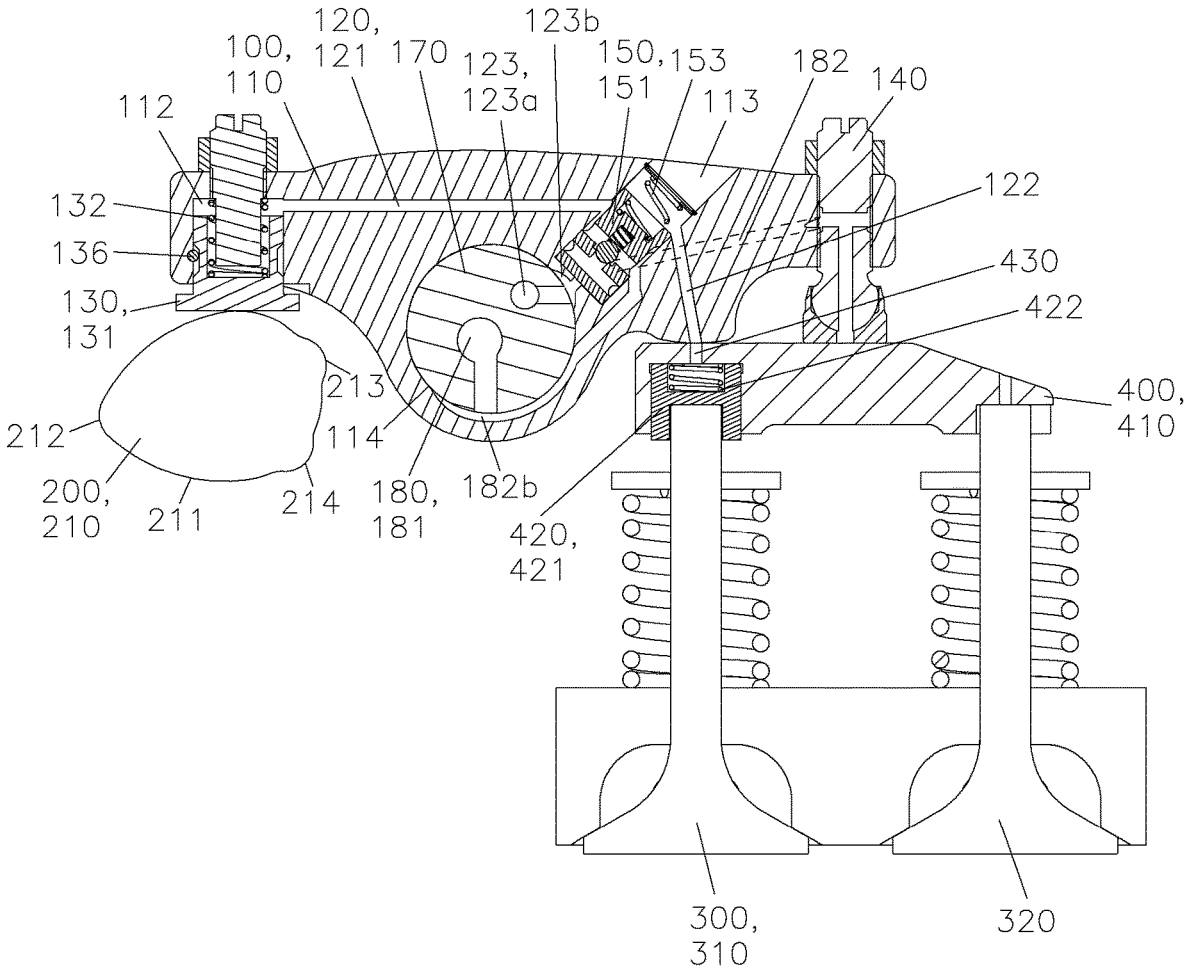
FIG. 16 is a 2D view of Embodiment 7 of the present invention.

Embodiment 7 shown in FIG. 16 only differs from Embodiment 1 in the following. The lower end of the primary piston body 131 is not provided with the roller pin 134 and the roller 135. The lower end surface of the primary piston body 131 directly contacts the integrated cam 210. There is no need to provide an anti-rotation assembly between the primary piston body 131 and the primary piston hole 112, and only an anti-dropping assembly is required. In this embodiment, the anti-dropping assembly is a limit pin 136. The limit pin 136 is fixedly provided on an inner circumferential surface of the primary piston hole 112. The primary piston body 131 is provided with a limit opening 131*a*. The limit opening 131*a* is provided along an axial direction of the primary piston body 131. The limit pin 136 is inserted in the limit opening 131*a*. The length of the limit opening 131*a* is greater than or equal to a movement stroke of the primary piston body 131. The limit pin 136 restricts the primary piston body 131 from moving out of the primary piston hole 112.

Embodiment 8

Figure 17:
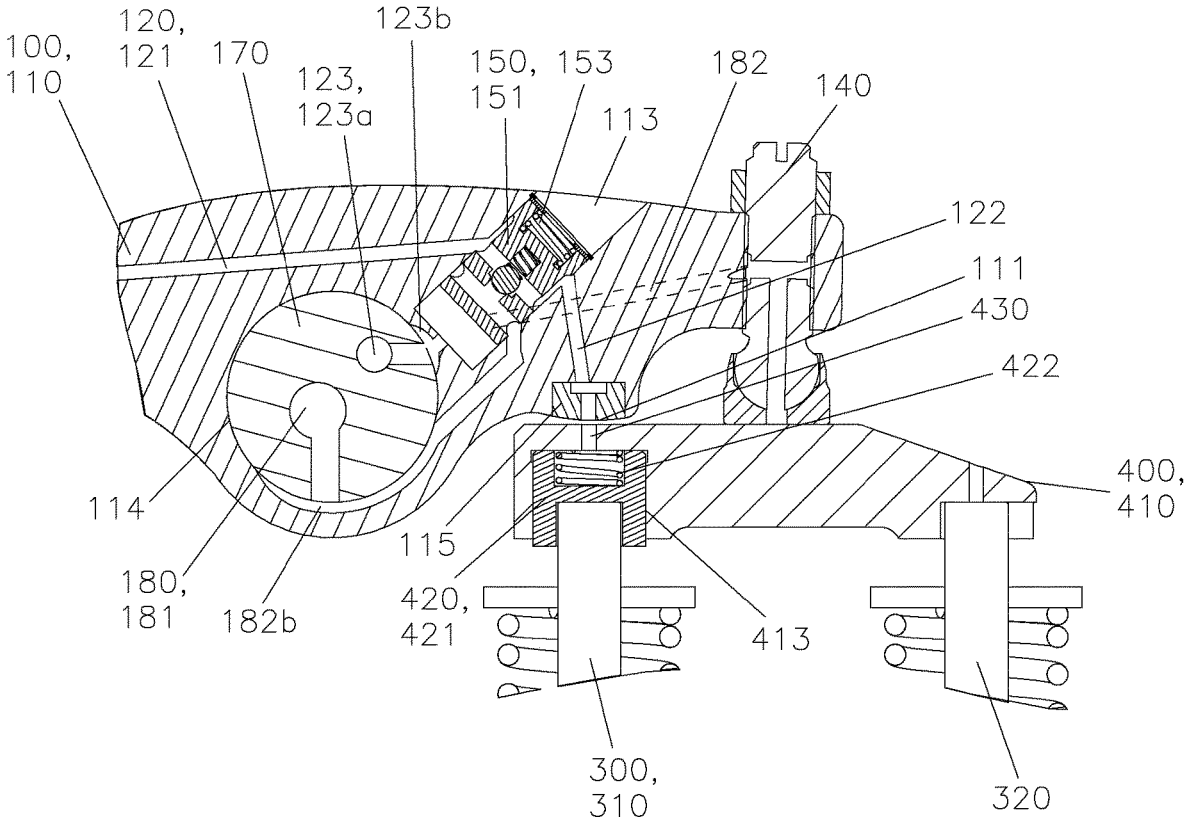
FIG. 17 is a 2D view of Embodiment 8 of the present invention.

Embodiment 8 shown in FIG. 17 only differs from Embodiment 1 in the following. In order to meet the requirements of different manufacturing processes, the rocker arm body 110 is provided with an insert 115 in an interference fit manner, and a lower surface of the insert 115 is a limit surface 111. The insert 115 may be separately hardened or treated by other process to enhance the flexibility of process design.

Embodiment 9

A self-resetting single-valve double-piston hydraulic drive method for an overhead cam engine, where an engine drive solenoid valve has two working states, namely an opened state and a closed state.

When the engine drive solenoid valve is in the opened state, a rotation process along an integrated cam 210 is implemented by the following steps:

Step 1: When the engine drive solenoid valve is opened, a rocker arm shaft oil supply passage 123*a*, a connecting oil supply passage 123*b* and the bottom of a control valve hole 113 are filled with oil. An oil pressure of the bottom of the control valve hole 113 is greater than a force of an elastic return element 153 acting on a control valve body 151. The control valve body 151 moves up to an opened position under the action of the oil pressure. A primary control valve oil passage 151*a* connects a primary piston oil passage 121 with a secondary piston oil passage 122.

Step 2: When the integrated cam 210 rotates to a cam base circle 211, a one-way valve ball 152*a* is opened under an oil pressure of a secondary control valve oil passage 151*b* to connect the primary control valve oil passage 151*a*. Lubricating oil flows into a drive control valve 150 and an entire driving oil passage 120. A primary piston hole 112 is filled with oil. A rocker arm body 110 is biased to a side of a valve bridge body 410 under the action of an oil pressure of the primary piston hole 112. A limit assembly 500 is tightly attached to an upper surface of the valve bridge body 410, such that the secondary piston oil passage 122 is connected with an oil drain passage 430 on the upper surface of the valve bridge body 410. The primary piston hole 112 and a secondary piston hole 413 are connected through the primary piston oil passage 121, the primary control valve oil passage 151*a*, the secondary piston oil passage 122 and the oil drain passage 430, and are filled with the lubricating oil simultaneously.

Step 3: During a drive lift of the integrated cam 210, an integrated cam assembly 200 pushes the primary piston body 131 upward, such that the primary piston body 131 moves upward along the primary piston hole 112. The one-way valve ball 152*a* seals a communication passage 151*c*, and the drive control valve 150 is in a locked state. The lubricating oil in the primary piston hole 112 is pressed into the secondary piston hole 413, such that a primary driving piston 130 and a secondary driving piston 420 form a hydraulic linkage. The secondary driving piston 420 pushes away an inner-side exhaust valve 310 connected to the secondary driving piston 420. The rocker arm body 110 and the valve bridge body 410 do not move. Thus, a drive function of a drive mechanism is realized.

Step 4: During a positive-power exhaust lift of the integrated cam 210, the integrated cam assembly 200 pushes the primary piston body 131 upward, such that the primary piston body 131 moves upward along the primary piston hole 112. When the primary piston body 131 is pressed against the bottom of an adjusting bolt 133 or the bottom of the primary piston hole 112, the primary piston body 131 and the rocker arm body 110 are rigidly connected. The rocker arm body 110 starts to rotate, and a valve bridge assembly 400 is pushed down through a first elephant foot assembly 140. A limit surface 111 is separated from the upper surface of the valve bridge body 410, and the oil drain passage 430 on the upper surface of the valve bridge body 410 is automatically opened. The secondary piston body 421 is in contact with the bottom of the secondary piston hole 413. The valve bridge assembly 400 is automatically reset to restore normal valve movement.

When the engine drive solenoid valve is in the closed state, the rotation process along the integrated cam 210 is implemented by the following steps:

Step 1: When the engine drive solenoid valve is closed, no oil pressure exists in the rocker arm shaft oil supply passage 123*a*. The control valve body 151 is in the closed position at the bottom of the control valve hole 113 under the action of the elastic return element 153. The primary piston oil passage 121 and the secondary piston oil passage 122 are not connected. No oil pressure exists in the control valve oil supply passage 123. The primary piston oil passage 121 and the primary piston hole 112 are filled with the lubricating oil. The secondary piston oil passage 122 is connected with an open chamber, and no oil pressure exists in the secondary piston oil passage 122.

Step 2: When the integrated cam 210 rotates to the cam base circle 211, the lubricating oil fills the primary piston hole 112. The rocker arm assembly 100 is biased to a side of the valve bridge assembly 400. The primary driving piston 130 absorbs the drive lift of the integrated cam assembly 200 for the rocker arm body 110. The primary driving piston 130 and the rocker arm body 110 form a hydraulic clearance adjuster to adjust a valve clearance.

Step 3: During the drive lift of the integrated cam 210, the integrated cam assembly 200 pushes the primary piston body 131 upward, such that the primary piston body 131 moves upward along the primary piston hole 112. The rocker arm body 110 is still biased to the side of the valve bridge body 410 under the action of the oil pressure of the primary piston hole 112, but does not rotate. The drive lift of the integrated cam 210 is absorbed by the primary driving piston 130 and is not transmitted to the side of the valve bridge body 410. Thus, a positive-power "lost motion" function of the drive mechanism is realized.

Step 4: During the positive-power exhaust lift of the integrated cam 210, the integrated cam assembly 200 pushes the primary piston body 131 upward, such that the primary piston body 131 moves upward along the primary piston hole 112. When the primary piston body 131 is pressed against the bottom of the adjusting bolt 133 or the bottom of the primary piston hole 112, the primary piston body 131 and the rocker arm body 110 are rigidly connected. The rocker arm body 110 rotates, and the valve bridge assembly 400 is pushed down through the first elephant foot assembly 140 to achieve positive valve movement.

Under the inspiration of the above ideal embodiment of the present invention, a skilled person can absolutely make various changes and modifications through the above description content without departing from the scope of the technical idea of the present invention. The technical scope of the present invention is not limited to the content of the description, which must be determined according to the scope of the claims.

What is claimed is:

1. A self-resetting single-valve double-piston hydraulic drive device for an overhead cam engine, the hydraulic drive device comprising:

a rocker arm assembly including:

a rocker arm body defining a driving oil passage, a drive control valve configured to selectively open the driving oil passage, a primary driving piston arranged at a first end of the rocker arm body, and a first elephant foot assembly arranged at a second end of the rocker arm body;

an integrated cam arranged below the primary driving piston, the integrated cam configured to rotate the rocker arm body;

an exhaust valve assembly including an inner-side exhaust valve and an outer-side exhaust valve;

a valve bridge assembly including:

a valve bridge body arranged below the first elephant foot assembly, the valve bridge body defining an oil drain passage, and a secondary driving piston configured to engage one of the inner-side exhaust valve or the outer-side exhaust valve, the secondary driving piston selectively connected to the driving oil passage via the oil drain passage; and a limit assembly arranged above the oil drain passage, wherein the driving oil passage is configured to connect the primary driving piston to the secondary driving piston, wherein an engine drive solenoid is configured to control the drive control valve such that:

when the drive control valve opens the driving oil passage, (i) during a drive lift of the integrated cam, the limit assembly is in contact with the valve bridge body so as to seal the oil drain passage and form a hydraulic linkage between the primary driving piston and the secondary driving piston, the drive lift of the integrated cam moves the primary driving piston within the rocker arm body so as to drive the secondary driving piston to open the one of the inner-side exhaust valve or the outer-side exhaust valve in such a way that the rocker arm body and the valve bridge body do not move; and (ii) during a positive-power exhaust lift of the integrated cam, the limit assembly is separated from the valve bridge body so as to open the oil drain passage and reset the secondary driving piston, the primary driving piston and the rocker arm body are rigidly connected as the rocker arm body rotates so as to drive the valve bridge body to open the inner-side exhaust valve and the outer-side exhaust valve, and when the drive control valve closes the driving oil passage, (i) during the drive lift of the integrated cam, the primary driving piston absorbs the drive lift of the integrated cam within the rocker arm body such that the rocker arm body does not move and the exhaust valves do not open, and (ii) during the positive-power exhaust lift of the integrated cam, the primary driving piston and the rocker arm body are rigidly connected as the rocker arm body rotates so as to drive the valve bridge body to open the inner-side exhaust valve and the outer-side exhaust valve, and wherein, the driving oil passage comprises a primary piston oil passage configured to connect the primary driving piston to the drive control valve, a secondary piston oil passage configured to connect the secondary driving piston to the drive control valve, and a control valve oil supply passage configured to connect the engine drive solenoid to the drive control valve.

2. The hydraulic drive device according to claim 1, wherein the secondary driving piston engages the inner-side exhaust valve.

3. The hydraulic drive device according to claim 2, wherein the limit assembly is arranged on the rocker arm body as a limit surface configured to limit the valve bridge body and seal the oil drain passage when the limit surface is in contact with the valve bridge body.

4. The hydraulic drive device according to claim 3, wherein the secondary piston oil passage connects the drive control valve to the limit surface such that the secondary piston oil passage is connected to the oil drain passage when the limit surface is in contact with the valve bridge body.

5. The hydraulic drive device according to claim 3, wherein the secondary piston oil passage is connected to the first elephant foot assembly, the valve bridge body further defines an inner-side connection passage, and the first elephant foot assembly is connected to the secondary driving piston via the inner-side connection passage.

6. The hydraulic drive device according to claim 2, wherein the secondary piston oil passage is connected to a second elephant foot assembly arranged in the rocker arm body directly above the oil drain passage, the second elephant foot assembly is connected to the oil drain passage when a lower end of the second elephant foot assembly is in contact with the valve bridge body.

7. The hydraulic drive device according to claim 2, wherein the secondary driving piston includes a secondary piston body connected to the inner-side exhaust valve, the valve bridge body including a secondary piston hole connected to the oil drain passage, the secondary piston hole configured to coaxially and slidably receive the secondary piston body, and a secondary elastic element arranged between the secondary piston body and the secondary piston hole.

8. The hydraulic drive device according to claim 7, wherein the drive control valve comprises a control valve body including a primary control valve oil passage, and a return assembly in contact with the control valve body, the rocker arm body includes a control valve hole configured to coaxially and slidably receive the control valve body, wherein, when the engine drive solenoid valve opens the drive control valve, the rocker arm shaft oil supply passage, the control valve oil supply passage, and a bottom of the control valve hole are filled with oil, an oil pressure of the bottom of the control valve hole is greater than a force of the return assembly acting on the control valve body such that the control valve body moves up to an opened position under an action of the oil pressure, and the primary control valve oil passage connects the primary piston oil passage to the secondary piston oil passage, and wherein, when the engine drive solenoid valve closes the drive control valve, no oil pressure exists in the rocker arm shaft oil supply passage and the control valve oil supply passage, the control valve body is in a closed position at the bottom of the control valve hole under an action of the return assembly, and the primary control valve oil passage remains connected to the primary piston oil passage and is disconnected from the secondary piston oil passage.

9. The hydraulic drive device according to claim 8, wherein the rocker arm assembly further includes a lubricating oil passage connecting the first elephant foot assembly to the control valve hole, the control valve body further including a secondary control valve oil passage connected to the primary control valve oil passage via a communication passage of the control valve body, the communication passage including a one-way valve, wherein, when the engine drive solenoid valve opens the drive control valve, (i) when the integrated cam is on a cam base circle, an oil pressure of the secondary control valve oil passage is greater than an oil pressure of the primary control valve oil passage such that the one-way valve opens the communication passage and the lubricating oil passage is connected to the secondary control valve oil passage, the primary control valve oil passage, and the driving oil passage; (ii) during the drive lift of the integrated cam, the oil pressure of the primary control valve oil passage is greater than the oil pressure of the secondary control valve oil passage such that the one-way valve seals the communication passage and the lubricating oil passage is connected to the secondary control valve oil passage and is disconnected from the primary control valve oil passage and the driving oil passage; and (iii) during the positive-power lift of the integrated cam, the oil pressure of the secondary control valve oil passage is greater than the oil pressure of the primary control valve oil passage such that the one-way valve opens the communication passage and the lubricating oil passage is connected to the secondary control valve oil passage, the primary control valve oil passage, and the driving oil passage; and wherein, when the engine drive solenoid valve closes the drive control valve, the lubricating oil passage is connected to the primary control valve oil passage and the oil pressure of the primary control valve oil passage is greater than the oil pressure of the secondary control valve oil passage such that the one-way valve seals the communication passage, the rocker arm assembly is biased towards the valve bridge assembly after lubricating oil fills the primary piston hole, and the primary driving piston and the rocker arm body form a hydraulic clearance adjuster configured to adjust a valve clearance.

10. The hydraulic drive device according to claim 8, wherein the return assembly includes a control valve limit ring coaxially fixed at an open end of the control valve hole, and an elastic return element arranged between the control valve body and the control valve limit ring, and wherein, when the drive control valve is closed, the control valve body and the control valve limit ring are spaced apart so as to form an open chamber connected to the secondary piston oil passage.

11. The hydraulic drive device according to claim 1, wherein the secondary driving piston engages the outer-side exhaust valve, the secondary piston oil passage is connected to the first elephant foot assembly, the valve bridge body further defines an outer-side connection passage, and the first elephant foot assembly is connected to the secondary driving piston via the outer-side connection passage.

12. The hydraulic drive device according to claim 11, wherein the limit assembly includes a limit rod arranged directly above the oil drain passage, the limit rod configured to seal the oil drain passage when the limit rod is in contact with the valve bridge body.

13. The hydraulic drive device according to claim 12, wherein the limit assembly further includes a bracket in which the limit rod is adjustably arranged.

14. The hydraulic drive device according to claim 11, wherein the secondary driving piston includes a secondary piston body connected to the outer-side exhaust valve, the valve bridge body including a secondary piston hole connected to the oil drain passage, the secondary piston hole configured to coaxially and slidably receive the secondary piston body, and a secondary elastic element arranged between the secondary piston body and the secondary piston hole.

15. The hydraulic drive device according to claim 1, wherein the primary driving piston includes a primary piston body, the first end of the rocker arm body includes a primary piston hole connected to the primary piston oil passage, the primary piston hole configured to coaxially and slidably receive the primary piston body, a primary elastic element and an anti-dropping assembly are arranged between the primary piston body and the primary piston hole, the anti-dropping assembly configured to restrict the primary piston body from moving out of the primary piston hole.

16. The hydraulic drive device according to claim 15, wherein a roller pin is fixed to a lower end of the primary piston body, a roller configured to engage the integrated cam is rotatably arranged on the roller pin, an anti-rotation assembly is arranged between the primary piston body and the primary piston hole, the anti-rotation assembly configured to restrict the primary piston body from rotating about a central axis of the primary piston body.

17. The hydraulic drive device according to claim 15, wherein the primary driving piston further includes an adjusting bolt threadedly provided on the rocker arm body so as to be axially inserted in the primary piston hole.

18. The hydraulic drive device according to claim 1, wherein the rocker arm assembly further includes a rocker arm shaft, the control valve oil supply passage comprises a rocker arm shaft oil supply passage arranged at the rocker arm shaft, and a connecting oil supply passage arranged at the rocker arm body, the connecting oil supply passage configured to connect the rocker arm shaft oil supply passage to the drive control valve arranged in the rocker arm body, the connecting oil supply passage including a connecting oil supply section connected to the drive control valve, and an annular oil supply section connected to the rocker arm shaft oil supply passage.

19. The hydraulic drive device according to claim 1, wherein the rocker arm assembly further includes a rocker arm shaft configured to engage with the drive control valve, each of an end of the primary piston oil passage and an end of the secondary piston oil passage is formed as an annular passage connected to the drive control valve.

20. The hydraulic drive device according to claim 1, wherein the limit assembly includes an insert arranged on the rocker arm body in an interference fit manner, a lower surface of the insert is formed as a limit surface.

* * * * *